US006992245B2

(12) United States Patent
Kenmochi et al.

(10) Patent No.: US 6,992,245 B2
(45) Date of Patent: Jan. 31, 2006

(54) SINGING VOICE SYNTHESIZING METHOD

(75) Inventors: Hideki Kenmochi, Shizuoka (JP); Alex Loscos, Barcelona (ES); Jordi Bonada, Stockholm (SE)

(73) Assignee: Yamaha Corporation, Hamamatsu (JP)

( * ) Notice: Subject to any disclaimer, the term of this patent is extended or adjusted under 35 U.S.C. 154(b) by 210 days.

(21) Appl. No.: 10/375,420

(22) Filed: Feb. 27, 2003

(65) Prior Publication Data

US 2003/0221542 A1 Dec. 4, 2003

(30) Foreign Application Priority Data

Feb. 27, 2002 (JP) ..... 2002-052006

(51) Int. Cl.
*G10H 1/06* (2006.01)
*G10H 7/00* (2006.01)

(52) U.S. Cl. ..... 84/622; 84/603; 84/609; 84/649; 84/659

(58) Field of Classification Search ..... 84/602–606, 84/609–612, 622–627, 649–652, 659–663
See application file for complete search history.

(56) References Cited

U.S. PATENT DOCUMENTS 5,536,902 A * 7/1996 Serra et al. ..... 84/623
5,712,437 A * 1/1998 Kageyama ..... 84/610
5,744,742 A * 4/1998 Lindemann et al. ..... 84/623
5,750,912 A * 5/1998 Matsumoto ..... 84/609
6,101,469 A * 8/2000 Curtin ..... 704/258
6,836,761 B1 * 12/2004 Kawashima et al. ..... 704/258

OTHER PUBLICATIONS

Cheng-Yuan Lin et al., "An On-the-Fly Mandarin Singing Voice Synthesis System," *Advances in Multimedia Information Processing*, Third IEEE Pacific Rim Conference on Multimedia, pp. 631-638, 2002.

Jean Laroche and Mark Dolson, "New Phase-Vocoder Techniques for Pitch-Shifting, Harmonizing and Other Exotic Effects," Proc. 1999 IEEEE Workshop on Applications of Signal Processing to Audio and Acoustics, New York, Oct. 17-20, 1999.

Eric Moulines and Jean Laroche, "Non-parametric techniques for pitch-scale and time-scale modification of speech," *Speech Communication*, vol. 16, pp. 275-205 (1995).

Ph. Depalle et al., "The recreation of a castrato voice, Farinelli's voice," *Applications of Signal Processing to Audio and Acoustics*, 1995, IEEE Assp Workshop on New Paltz, Oct. 15-18, 1995.

(Continued)

*Primary Examiner*—Marlon T. Fletcher
(74) *Attorney, Agent, or Firm*—Pillsbury Winthrop Shaw Pittman LLP

(57) ABSTRACT

A frequency spectrum is detected by analyzing a frequency of a voice waveform corresponding to a voice synthesis unit formed of a phoneme or a phonemic chain. Local peaks are detected on the frequency spectrum, and spectrum distribution regions including the local peaks are designated. For each spectrum distribution region, amplitude spectrum data representing an amplitude spectrum distribution depending on a frequency axis and phase spectrum data representing a phase spectrum distribution depending on the frequency axis are generated. The amplitude spectrum data is adjusted to move the amplitude spectrum distribution represented by the amplitude spectrum data along the frequency axis based on an input note pitch, and the phase spectrum data is adjusted corresponding to the adjustment. Spectrum intensities are adjusted to be along with a spectrum envelope corresponding to a desired tone color. The adjusted amplitude and phase spectrum data are converted into a synthesized voice signal.

17 Claims, 18 Drawing Sheets

OTHER PUBLICATIONS

Perry R. Cook, "Toward the Perfect Audio Morph? Singing Voice Synthesis and Processing," Workshop on Digital Audio Effects, Nov. 19, 1998, pp. 223-230.

Jean Laroche, "Frequency-domain techniques for high-quality voice modification," Proc. of the 6th Int. Conference on Digital Audio Effects, London, UK, Sep. 8-11, 2003.

* cited by examiner

SINGING VOICE SYNTHESIZING METHOD

CROSS REFERENCE TO RELATED APPLICATION

This application is based on Japanese Patent Application 2002-052006, filed on Feb. 27, 2002, the entire contents of which are incorporated herein by reference.

BACKGROUND OF THE INVENTION

A) Field of the Invention

This invention relates to a singing voice synthesizing method, a singing voice synthesizing apparatus and a storage medium by using a phase vocoder technique.

B) Description of the Related Art

Conventionally, as a singing voice synthesizing technique, a singing voice synthesizing using a well-known Spectral Modeling Synthesis (SMS) technique according to U.S. Pat. No. 5,029,509 is well known. (For example, refer to Japanese Patent No. 2906970.)

FIG. 21 shows a singing voice synthesizing apparatus adopting the technique explained in Japanese Patent No. 2906970. At Step S1, a singing voice signal is input, and at Step S2, a SMS analyzing process and a section logging process is executed to the input singing voice signal.

In the SMS analyzing process, the input voice signal is divided into a series of time frames, and one set of a magnitude spectrum data is generated in each frame by Fast Fourier Transform (FFT) and the like, and a linear spectrum corresponding to plurality of peaks from one set of magnitude spectrum data by each frame. A data representing an amplitude value and frequency of these linear spectrums are called a Deterministic Component. Next, a spectrum of the deterministic component is subtracted from a spectrum of an input voice waveform to obtain a remaining difference spectrum. This remaining difference spectrum is called Stochastic Component.

In the section logging process, the deterministic component data and the stochastic data obtained in the SMS analyzing process are divided corresponding to a voice synthesis unit. The voice synthesis unit is a structural element of lyrics. For example, a voice synthesis unit is consisted of a single phoneme such as [a] or [i] or, a phonemic chain (a chain of a plurality of phonemes) such as [a_i] or [a_p].

In a voice synthesis unit database DB, a deterministic component data and stochastic component data are stored for every voice synthesis unit.

In the singing voice synthesizing, at Step S3, lyrics data and melody data are input. Then, at Step S4, a phonemic series/voice synthesis unit conversion process is executed on the phonemic series that the lyrics data represents to divide the phonemic series into a voice synthesis unit. Then, the deterministic component data and the stochastic component data are read from the database DB as a voice synthesis unit data for every voice synthesis unit.

At Step S5, a voice synthesis unit connecting process is executed on the voice synthesis unit data (the deterministic component data and the stochastic component data) read from the database DB to connect voice synthesis unit data in an order of pronunciations. At Step S6, new deterministic component data adapting to the musical note pitch is generated based on the musical note pitch that the deterministic component data and the melody data indicate for every voice synthesis unit. At this time, if a spectrum intensity is adjusted to be a form of a spectrum envelope that the deterministic component data processed at Step S5 is taken over, a musical tone of the voice signal input at Step S1 can be reproduced with the new deterministic component data.

At Step S7, the deterministic component data generated at Step S6 is added to the stochastic component data executed the process at Step S5 in every voice synthesis unit. Then, at Step S8, the data to which the adding process is executed at Step S7 is converted to a synthesized voice signal of time region by a reverse FFT and the like in each voice synthesis unit.

For example, to synthesizing a singing voice [saita], voice syntheses units corresponding to voice synthesis units [#s], [s_a], [a], [a_i], [l], [i_t], [a], and [a#] (# represents a silence) are read from the database DB, and they are connected each other at Step S5. Then, at Step S6, a deterministic component data that has a pitch corresponding to the input musical note pitch is generated in each voice synthesis unit. After the adding process at Step S7 and the converting process at Step S8, a singing voice signal of [saita] can be obtained.

According to the above-described prior art, there is a tendency that a sense of unity between the deterministic component and the stochastic component is not satisfactory. That is, there is a tendency that the singing voice is caught as an artificial voice because the voice signal pitch input at Step S1 is converted corresponding to the input musical note pitch at Step S6 and the stochastic component data is added to the deterministic component data with the converted pitch at Step S7. For example, the stochastic component data is sounded being split in a section of a long sound such as [i] in singing [saita].

In order to deal with this kind of tendencies, the inventors of the present invention suggested that an amplitude spectrum distribution in a lower region that the stochastic component data represents is adjusted corresponding to the input musical note pitch before (refer to Japanese Patent Application No. 2000-401041). However, if the stochastic component data is adjusted as above, it is not easy to control splitting and resounding of the stochastic component completely.

Also, in the SMS technique, analysis of a voiced fricative or plosive sound is difficult, and it is a problem that the synthesizing voice will be very artificial sound. The SMS technique is on the assumption that a voice signal is consisted of a deterministic component and a stochastic component, and it is a fundamental problem that the voice signal cannot be split into the deterministic component and the stochastic component as the SMS technique.

On the other hand, the phase vocoder technique is explained in a specification of the U.S. Pat. No. 3,360,610. In the phase vocoder technique, a signal was represented by a filter bank before and recently has been represented by a frequency region as a result of the FFT of input signal. Recently, the phase vocoder technique is widely used for a time-stretch (stretching or shortening of a time axis without changing the original pitch), a pitch-shift (changing a pitch without changing the time length) and the like. As this kind of pitch changing technique, the result of FFT of the input signal is not used as it is. It is well known that the pitch shift is executed by moving the spectrum distribution on a frequency axis in each spectrum distribution region after dividing the FFT spectrum into a plurality of spectrum distribution regions centered at a local peak. (For example, refer to J. Laroche and M. Dolson, "New Phase-Vocoder Techniques for Real-Time Pitch Shifting, Chourusing, Harmonizing, and Other Exotic Audio Modifications" J. Audio Eng. Soc., Vol. 47, No. 11, 1999). However, relevancy between the pitch shifting technique and the singing voice synthesizing technique is not clear.

SUMMARY OF THE INVENTION

It is an object of the present invention to provide a new singing voice synthesizing method or apparatus that enable a natural and high-quality voice synthesizing by using a phase vocoder technique, and a storage medium.

According to one aspect of the present invention, there is provided a singing voice synthesizing method, comprising the steps of: (a) detecting a frequency spectrum by analyzing a frequency of a voice waveform corresponding to voice synthesis unit of a voice to be synthesized; (b) detecting a plurality of local peaks of a spectrum intensity on the frequency spectrum; (c) designating, for each of the plurality of the local peaks, a spectrum distribution region including the local peak and spectrums therebefore and thereafter on the frequency spectrum and generating amplitude spectrum data representing an amplitude spectrum distribution depending on a frequency axis for each spectrum distribution region; (d) generating phase spectrum data representing a phase spectrum distribution depending on the frequency axis for each spectrum distribution region; (e) designating a pitch for the voice to be synthesized; (f) adjusting, for each spectrum distribution regions, the amplitude spectrum data for moving the amplitude spectrum distribution represented by the amplitude spectrum data along the frequency axis in accordance with the pitch; (g) adjusting, for each spectrum distribution regions, the phase spectrum distribution represented by the phase spectrum data in accordance with the adjustment of the amplitude spectrum data; and (h) converting the adjusted amplitude spectrum data and the adjusted phase spectrum data into a synthesized voice signal of a time region.

According to the first singing voice synthesizing method, a voice waveform corresponding to a voice synthesis unit (a phoneme or a phonemic chain) is executed a frequency analysis, and a frequency spectrum is detected. Then an amplitude spectrum data and a phase spectrum data are generated based on the frequency spectrum. When a desired pitch is designated, the amplitude spectrum data and the phase spectrum data are adjusted corresponding to the designated pitch, and a synthesized voice signal in a time region is generated based on the adjusted amplitude spectrum data and the adjusted phase spectrum data. Because voice synthesizing is executed without splitting the result of the frequency analysis of the voice waveform into a deterministic component and a stochastic component, the stochastic component may not split and resound. Therefore, a natural synthesized sound can be obtained. Also, a natural synthesized sound can be obtained in a case of a voiced fricative or plosive sound.

According to another aspect of the present invention, there is provided a singing voice synthesizing method, comprising the steps of. (a) obtaining amplitude spectrum data and phase spectrum data corresponding to a voice synthesis unit of a voice to be synthesized, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of the voice synthesis unit, and the phase spectrum data is data representing a phase spectrum distribution depending on the frequency axis for each spectrum distribution region; (b) designating a pitch for the voice to be synthesized; (c) adjusting, for each spectrum distribution regions, the amplitude spectrum data for moving the amplitude spectrum distribution represented by the amplitude spectrum data along the frequency axis in accordance with the pitch; (d) adjusting, for each spectrum distribution regions, the phase spectrum distribution represented by the phase spectrum data in accordance with the adjustment of the amplitude spectrum data; and (e) converting the adjusted amplitude spectrum data and the adjusted phase spectrum data into a synthesized voice signal of a time region.

The second singing voice synthesizing method corresponds to the case that the amplitude spectrum data and the phase spectrum data are stored in a database in each voice synthesis unit after executing the processes up to the step of generating the phase spectrum data, or the case that the process up to the step of generating the phase spectrum data is executed with other apparatus. That is, in the second singing voice synthesizing method, in a obtaining step, the amplitude spectrum data and the phase spectrum data corresponding to the voice synthesis unit of the voice to be synthesized are obtained from other apparatus or the database, and a process after the step to designate pitch is executed in the same method as the first singing voice synthesizing method. Therefore, according to the second singing voice synthesizing method, a natural synthesized sound can be obtained as the first singing voice synthesizing method.

According to further aspect of the present invention, there is provided a singing voice synthesizing apparatus, comprising: a designating device that designates a voice synthesis unit and a pitch for a voice to be synthesized; a reading device that reads voice waveform data representing a waveform corresponding to the voice synthesis unit as voice synthesis unit data from a voice synthesis unit database; a first detecting device that detects a frequency spectrum by analyzing a frequency of the voice waveform represented by the voice waveform data; a second detecting device that detects a plurality of local peaks of a spectrum intensity on the frequency spectrum; a first generating device that designates, for each of the plurality of the local peaks, a spectrum distribution region including the local peak and spectrums therebefore and thereafter on the frequency spectrum and generates amplitude spectrum data representing an amplitude spectrum distribution depending on a frequency axis for each spectrum distribution region; a second generating device that generates phase spectrum data representing a phase spectrum distribution depending on the frequency axis for each spectrum distribution region; a first adjusting device that adjusts, for each spectrum distribution regions, the amplitude spectrum data for moving the amplitude spectrum distribution represented by the amplitude spectrum data along the frequency axis in accordance with the pitch; a second adjusting device that adjusts, for each spectrum distribution regions, the phase spectrum distribution represented by the phase spectrum data in accordance with the adjustment of the amplitude spectrum data; and a converting device that converts the adjusted amplitude spectrum data and the adjusted phase spectrum data into a synthesized voice signal of a time region.

According to yet further aspect of the present invention, there is provided a singing voice synthesizing apparatus, comprising: a designating device that designates a voice synthesis unit and a pitch for a voice to be synthesized; a reading device that reads amplitude spectrum data and phase spectrum data corresponding to the voice synthesis unit as voice synthesis unit data from a voice synthesis unit database, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of the voice synthesis unit, and the phase spectrum data is data representing a phase spectrum distribution depending on the frequency axis for each spectrum distribution region; a first adjusting device that adjusts, for each spectrum distribution regions, the amplitude spectrum data for moving the amplitude spectrum distribution represented by the amplitude spectrum data along the frequency axis in accordance with the pitch; a second adjusting device that adjusts, for each spectrum distribution regions, the phase spectrum distribution represented by the phase spectrum data in accordance with the adjustment of the amplitude spectrum data; and a converting device that converts the adjusted amplitude spectrum data and the adjusted phase spectrum data into a synthesized voice signal of a time region.

The first and second singing voice synthesizing apparatuses are to execute the before-described first and second singing voice synthesizing methods by using the voice synthesis unit database, and a natural singing voice synthesized voice can be obtained.

According to yet further aspect of the present invention, there is provided a singing voice synthesizing apparatus, comprising: a designating device that designates a voice synthesis unit and a pitch for each of voices to be sequentially synthesized; a reading device that reads voice waveform data corresponding to each of the voice synthesis unit designated by the designating device from a voice synthesis unit database; a first detecting device that detects a frequency spectrum by analyzing a frequency of the voice waveform corresponding to each voice waveform; a second detecting device that detects a plurality of local peaks of a spectrum intensity on the frequency spectrum corresponding to each voice waveform; a first generating device that designates, for each of the plurality of the local peaks for each voice synthesis unit, a spectrum distribution region including the local peak and spectrums therebefore and thereafter on the frequency spectrum and generates amplitude spectrum data representing an amplitude spectrum distribution depending on a frequency axis for each spectrum distribution region; a second generating device that generates phase spectrum data representing a phase spectrum distribution depending on the frequency axis for each spectrum distribution region of each voice synthesis unit; a first adjusting device that adjusts, for each spectrum distribution regions of each voice synthesis unit, the amplitude spectrum data for moving the amplitude spectrum distribution represented by the amplitude spectrum data along the frequency axis in accordance with the pitch; a second adjusting device that adjusts, for each spectrum distribution regions of each voice synthesis unit, the phase spectrum distribution represented by the phase spectrum data in accordance with the adjustment of the amplitude spectrum data; a first connecting device that connects the adjusted amplitude spectrum data to connect sequential voice synthesis units respectively corresponding to the voices to be sequentially synthesized in a pronunciation order, wherein the spectrum intensities are adjusted to be agreed or approximately agreed with each another at connection points of the sequential voice synthesis units; a second connecting device that connects the adjusted phase spectrum data to connect sequential voice synthesis units respectively corresponding to the voices to be sequentially synthesized in a pronunciation order, wherein the phases are adjusted to be agreed or approximately agreed with each another at connection points of the sequential voice synthesis units; and a converting device that converts the connected amplitude spectrum data and the connected phase spectrum data into a synthesized voice signal of a time region.

According to yet further aspect of the present invention, there is provided a singing voice synthesizing apparatus, comprising: a designating device that designates a voice synthesis unit and a pitch for each of voices to be sequentially synthesized; a reading device that reads voice waveform data corresponding to each of the voice synthesis unit designated by the designating device from a voice synthesis unit database, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of the voice synthesis unit, and the phase spectrum data is data representing a phase spectrum distribution depending on the frequency axis for each spectrum distribution region; a first adjusting device that adjusts, for each spectrum distribution regions of each voice synthesis unit, the amplitude spectrum data for moving the amplitude spectrum distribution represented by the amplitude spectrum data along the frequency axis in accordance with the pitch; a second adjusting device that adjusts, for each spectrum distribution regions of each voice synthesis unit, the phase spectrum distribution represented by the phase spectrum data in accordance with the adjustment of the amplitude spectrum data; a first connecting device that connects the adjusted amplitude spectrum data to connect sequential voice synthesis units respectively corresponding to the voices to be sequentially synthesized in a pronunciation order, wherein the spectrum intensities are adjusted to be agreed or approximately agreed with each another at connection points of the sequential voice synthesis units; a second connecting device that connects the adjusted phase spectrum data to connect sequential voice synthesis units respectively corresponding to the voices to be sequentially synthesized in a pronunciation order, wherein the phases are adjusted to be agreed or approximately agreed with each another at connection points of the sequential voice synthesis units; and a converting device that converts the connected amplitude spectrum data and the connected phase spectrum data into a synthesized voice signal of a time region.

The third and the fourth singing voice synthesizing apparatuses are to execute the before described first or second singing voice synthesizing methods by using the voice synthesis unit database, and can obtain a natural singing voice synthesized sound. Moreover, spectral intensities and phases at a connecting part of the sequential voice synthesis units are adjusted to be the same or approximately the same to each other at the time of connecting the amplitude spectral data and the phase spectral data to be modified for connecting the voice synthesis units in the order of the pronunciation; therefore, it is prevented to generate noise at the time of generating the synthesized voice.

According to the present invention, amplitude spectrum data and phase spectrum data are generated based on a result of a frequency analyzing of a voice waveform corresponding to a voice synthesis unit, and the amplitude spectrum data and the phase spectrum data are adjusted corresponding to a designated pitch. Then, since a synthesized voice signal in a time region is generated based on the adjusted amplitude spectrum data and the adjusted phase spectrum data, a situation that the stochastic component splits and resounds as the conventional example that the result of the frequency analysis is split into the deterministic component and the stochastic component will not occur principally, and an effect that enables a natural or high-quality singing voice synthesizing can be obtained.

DETAILED DESCRIPTION OF THE PREFERRED EMBODIMENTS

Figure 1:
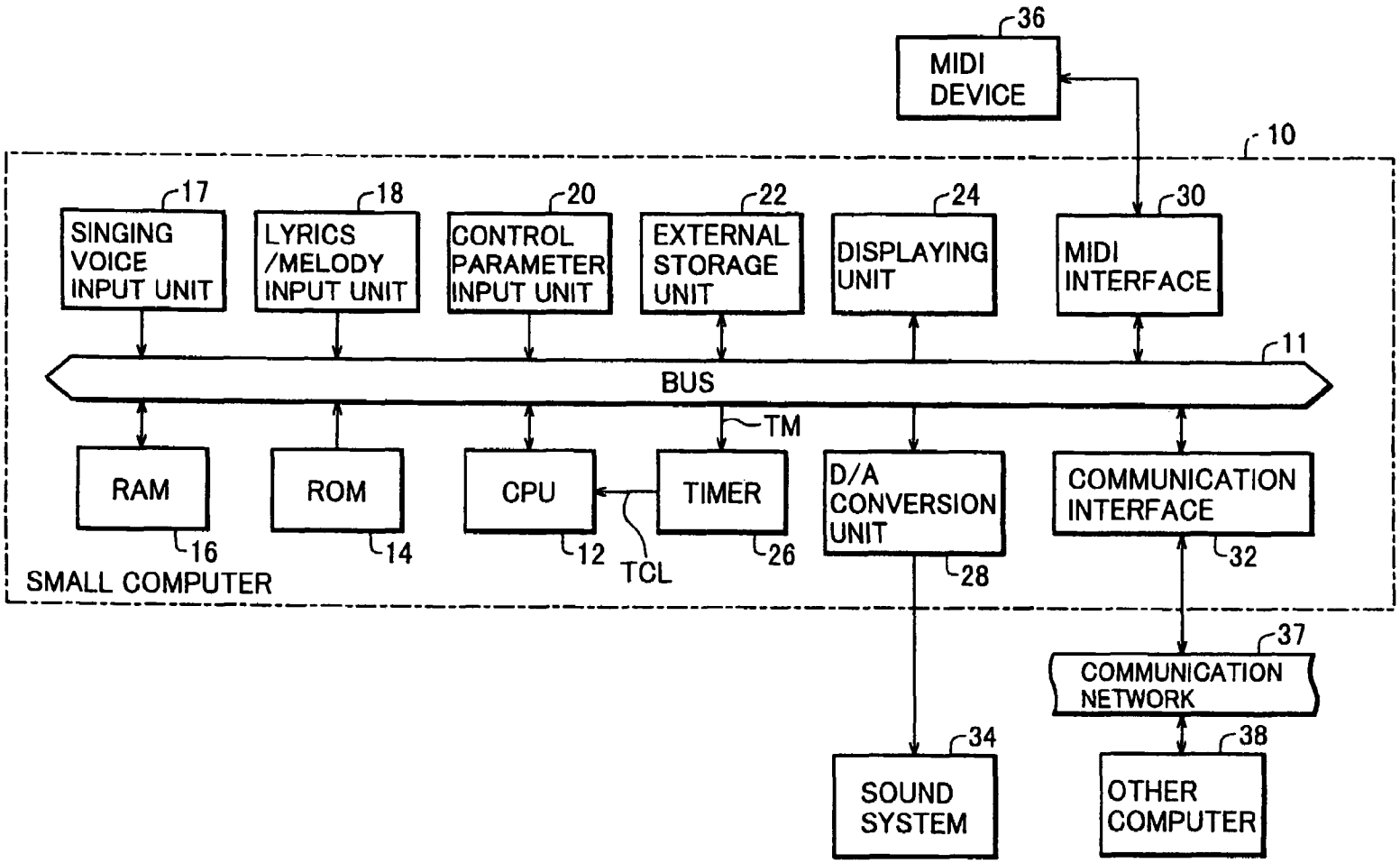
FIG. 1 is a block diagram showing a circuit structure of a singing voice synthesizing apparatus according to an embodiment of the present invention.

FIG. 1 is a block diagram showing a circuit structure of a singing voice synthesizing apparatus according to an embodiment of the present invention. This singing voice synthesizing apparatus has a structure wherein a small computer 10 controls operations.

A central processing unit (CPU) 12, a read only memory (ROM) 14, a random access memory (RAM) 16, a singing voice input unit 17, a lyrics/melody input unit 18, a control parameter input unit 20, an external storage unit 22, a displaying unit 24, a timer 26, a digital/analogue (D/A) conversion unit 28, a musical instrument digital interface (MIDI) interface 30, a communication interface 32 and the like are connected to a bus 11.

The CPU executes various kinds of processes related to the singing voice synthesizing and the like according to a program stored in the ROM 14. The processes related to the singing voice synthesizing are explained later referring FIGS. 2 to 7 and the like.

The RAM 16 includes various kinds of storing regions such as a working region at a time of various processes in the CPU 12. As the storing regions according to the embodiment of the present invention, for example, inputting data storing regions are respectively corresponding to the input units 17, 18 and 20. The details will be explained later.

The singing voice input unit 17 has a microphone, a voice inputting terminal and the like for inputting a singing voice signal, and equips an analog/digital (A/D) conversion device that converts the input singing voice signal to a digital waveform data. The digital waveform data to be input is stored in a predetermined region in the RAM 16.

The lyrics/melody input unit 18 includes a keyboard that can input letters and numbers, and a reading device that can read scores. It can input a melody data that represents a series of musical notes (including rest) and a lyrics data and melody that represents a phonemic series that consists of the lyrics of a desired singing voice. The lyrics data and the melody data to be input are stored in a predetermined region in the RAM 16.

The lyrics/melody input unit 18 equips a keyboard that can input letters and numbers, and a reading device that can read scores. It can input a melody data that represents a series of musical notes (including rest) that consists a lyrics data and melody that represents a phonemic series that consists the lyrics of a desired singing voice. The lyrics data and the melody data to be input are stored in a predetermined region in the RAM 16.

The control parameter input unit 20 equips parameter setting devices such as a switch, a volume and the like, and can set a control parameter for controlling a musical expression of the singing voice synthesized voice. A musical tone, a pitch classification (high, middle, low, etc.), a pitch throb (a pitch bend, vibrato, etc.), dynamics classification (high, middle, low, etc. of a volume level), a tempo classification (fast, middle, slow, etc. tempo) and the like can be set as the control parameter. The control parameter data that represents a control parameter to be set is stored in a predetermined region in the RAM 16.

The external storage unit 22 includes one or plural kinds of removable storing mediums such as a flexible disk (FD), a compact disk (CD), a digital versatile disk (DVD), a magneto optical disk (MO) and the like. Data can be transmitted from the storing medium to the RAM 16 in a state that a desired storing medium is loaded into the external storage unit 22. If a loaded medium is writable such as HD and FD, data in the RAM 16 can transmit to the storing medium.

As a program storing unit, a storing medium of the external storage unit can be used instead of the ROM 14. In this case, the program stored in the storing medium is transmitted from the external storage unit 22 to the RAM 16. Then, the CPU is executed operations according to the program stored in the RAM 16. By doing this, a program addition, version-up, etc. can easily be executed.

The displaying unit 24 includes a displaying device such as a liquid crystal displaying device, and can display various kids of information such as the above-described results of the frequency analysis and the like.

The timer 26 generates a tempo clock signal TCL in a cycle corresponding to a tempo that a tempo data TM designates, and the tempo clock signal TCL is provided to the CPU 12. The CPU 12 executes a signal outputting process to the D/A conversion unit 28 based on the tempo clock signal TCL. A tempo that the tempo data TM designates can be set flexibly by a tempo setting device in an input unit 20.

The D/A conversion unit 28 converts a synthesized digital voice signal to an analog voice signal. The analogue voice signal transmitted from the D/A conversion unit 28 is converted to audio sound by a sound system 34 including an amplifier, a speaker, etc.

The MIDI interface 30 is provided for executing a MIDI communication to a MIDI device 36 that is separate from this singing voice synthesizing apparatus, and is used for receiving data for singing voice synthesizing from the MIDI device 36 in the present invention. As a data for singing voice synthesizing, a lyrics data and a melody data corresponding to a desired singing voice, a control parameter data for controlling a musical expression and the like can be received. These data for singing voice synthesizing are formed according to what is called a MIDI format, and the MIDI format may preferably be adapted for the lyrics data and the melody data input from the input unit 18 and the control parameter data input from the input unit 20.

As for the lyrics data, the melody data and the control parameter data received via the MIDI interface 30, a MIDI system exclusive data, which a manufacturer can define on its own form will be preferable for enabling the data to be read before other data. Also, as for one kind of data of the control parameter data input from the input unit 20 and the control parameter data received via the MIDI interface 30, a singer (or a musical tone) designating data may be used in a case that the voice synthesis unit data is stored in a later-described database by each singer (or each musical tone). In this case, as for the singer (or musical tone) designating data, program change data of MIDI can be used.

The communication interface 32 is provided for data communication to other computer 38 via the communication network (for example, local area network (LAN), the Internet, and a telephone line) 37. The programs and various kinds of data necessary for executing the present invention (for example, the lyrics data, the melody data, the voice synthesis unit data, etc.) may be loaded from the computer 38 to the RAM 16 or the external storage unit 22 via the communication network 37 and the communication interface 32 according to a downloading demand.

Figure 2:
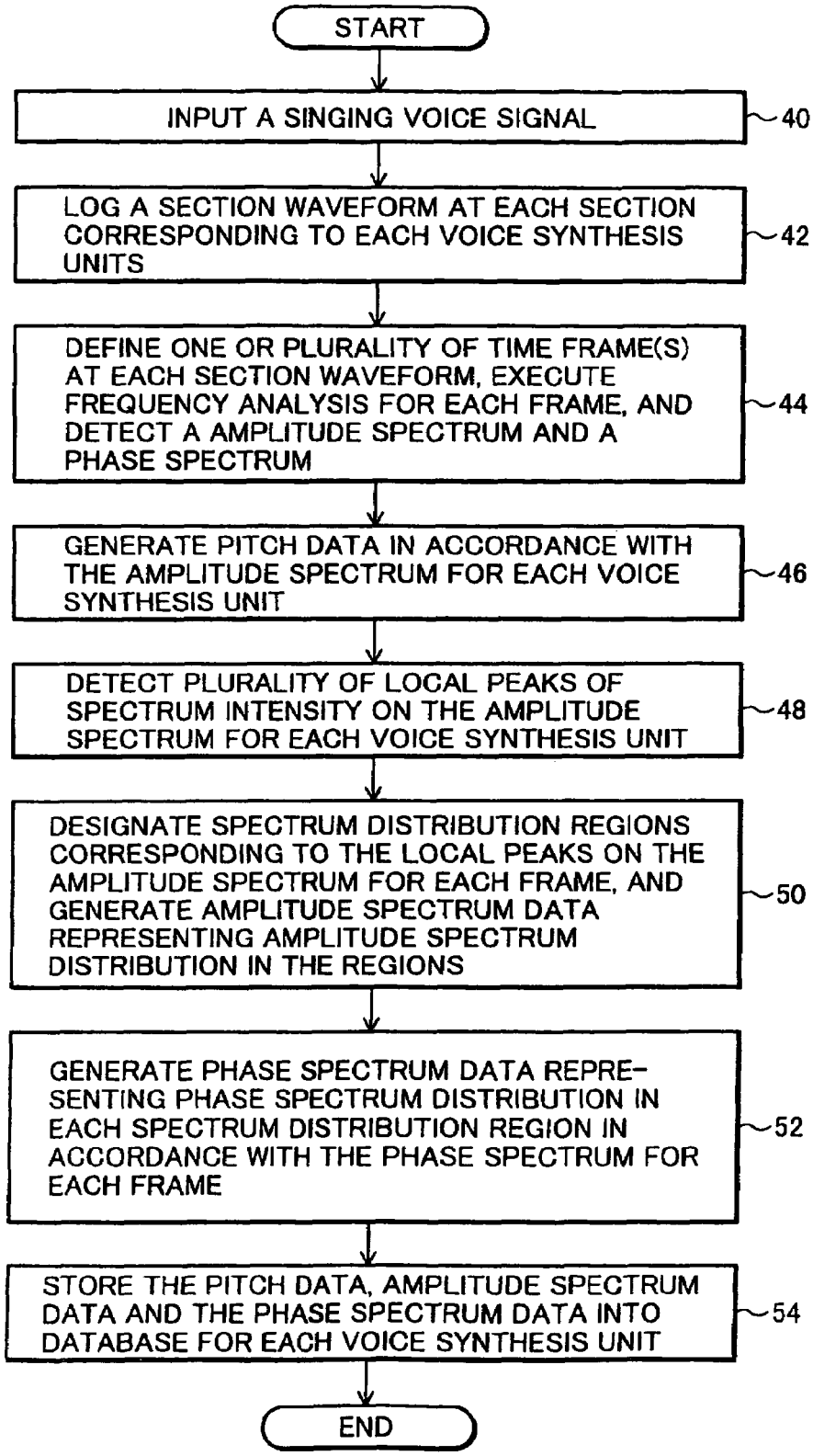
FIG. 2 is a flow chart showing an example of a singing voice analyzing process.
Figure 8A:
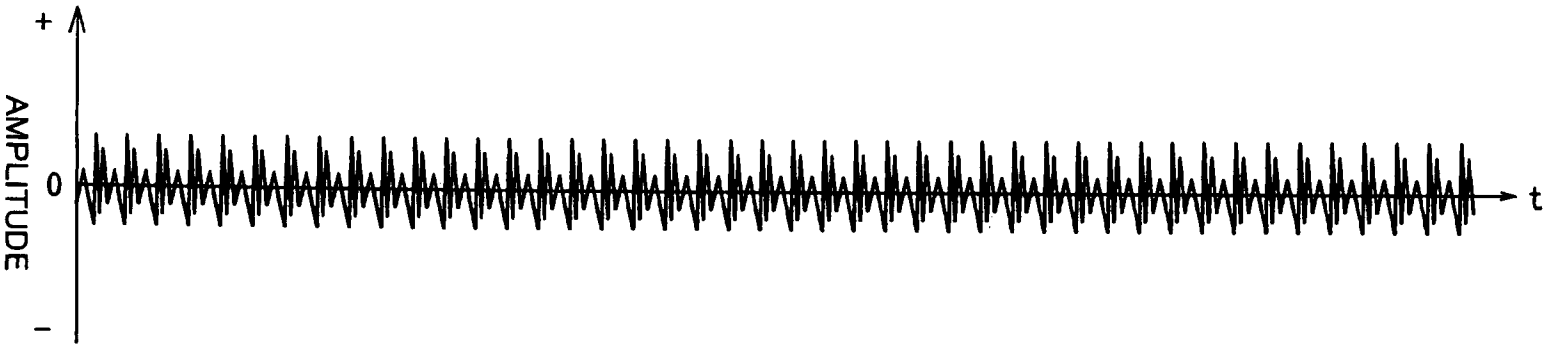
FIG. 8A is a waveform figure showing an input voice signal as an analyzing object.

Next, an example of the singing voice analyzing process is explained referring to FIG. 2. At Step 40, the singing voice signal is input from the input unit 17 via the microphone or the voice inputting terminal to execute the A/D conversion, and the digital waveform data that represents the voice waveform of the input signal is stored in the RAM 16. FIG. 8A shows an example of the input voice waveform. Moreover, in FIG. 8A and other figures, "t" represents time.

At Step 42, a section waveform is logged at each section corresponding to each voice synthesis unit (phoneme or phonemic chain) for the digital waveform data to be stored (the digital waveform data is divided). As for the voice synthesis unit, there are a vowel phoneme, a phonemic chain of vowel and consonant or consonant and vowel, phonemic chain of consonant and consonant, phonemic chain of vowel and vowel, a phonemic chain of silence and consonant or vowel, a phonemic chain of vowel or consonant and silence and the like. As for a vowel phoneme, there is a long sound phoneme that is sung by lengthening a vowel. As an example, as for a singing voice of [saita], a section waveform is logged corresponding to each of [#s], [s_a], [a], [a_i], [l], [i_t], [t_a], [a] and [a#].

Figure 8B:
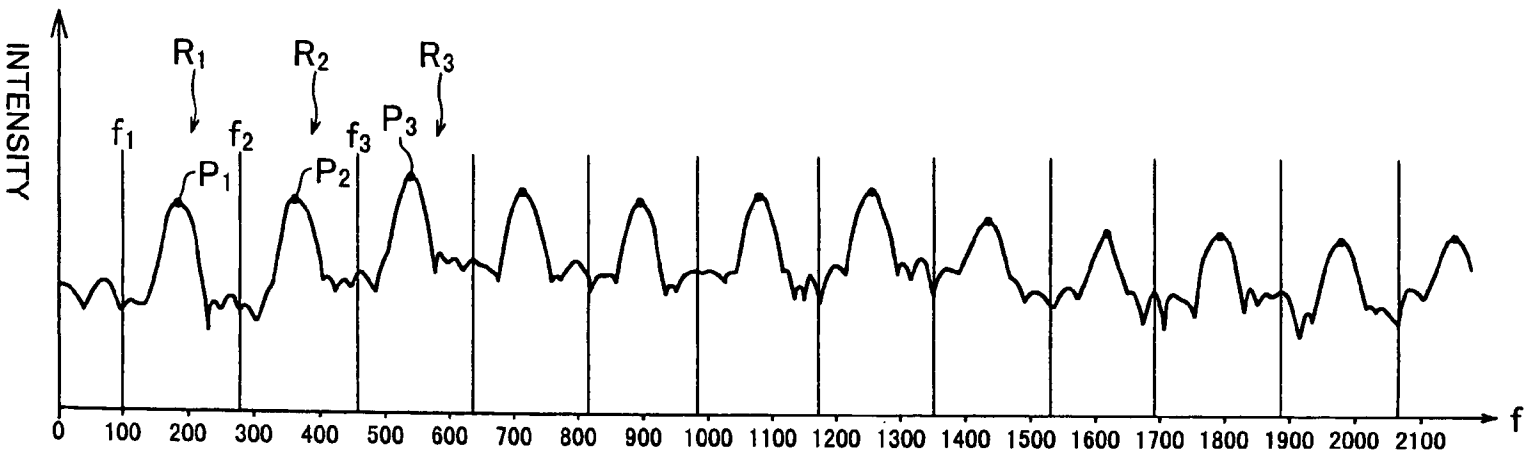
FIG. 8B is a spectrum figure showing a result of frequency analysis.

At Step 44, one or a plurality of time frame(s) is fixed by each section waveform, a frequency spectrum (an amplitude spectrum and a phase spectrum) are detected by executing the frequency analysis for each frame by the FFT and the like. Then, the data that represents the frequency spectrum is stored in a predetermined region in the RAM 16. A frame length may be a certain length or a flexible length. To make the frame length a flexible length, after the frequency analysis of one frame as a fixed length, a pitch is detected from the result of the frequency analysis, and a frame length corresponding to the detected pitch is set, and the frequency analysis can be executed on the frame again. In another case, after the frequency analysis of one frame as a fixed length, a pitch is detected from the result of the frequency analysis, a next frame length is set corresponding to the detected pitch, and the frequency analysis of the next frame can be executed. The number of frames will be one frame or a plurality of frames for a single phoneme consisted of only vowel, and will be a plurality of frames for the phonemic chain. In FIG. 8B, the frequency spectrum obtained by the frequency analysis of the voice waveform in FIG. 8A by the FFT is shown. Moreover, in FIG. 8B and other figures, "f" represents frequency.

Next, at Step 46, a pitch is detected based on the amplitude spectrum by voice synthesis unit, and a pitch data that represents a detected pitch is generated to store in a predetermined region in the RAM 16. The pitch detection can be executed by an averaging method of all frames of the pitches obtained by each frame.

At Step 48, plurality of local peaks of a spectrum intensity (amplitude) on the amplitude spectrum are detected by each frame. In order to detect the local peaks, a method wherein a peak whose amplitude value is the maximum is detected from the next plurality (for example, 4) peaks can be used. In FIG. 8B, the detected plurality of local peaks P1, P2, P3 . . . are indicated.

At Step 50, a spectrum distribution region corresponding to each local peak by each frame on the amplitude spectrum is designated, and an amplitude spectrum data represents the amplitude spectrum distribution in the region depending on the frequency axis to store in a predetermined region in the RAM 16. As a method for designating the spectrum distribution region, there are a method wherein each half of the frequency axes cut between two adjacent local peaks are assigned to a spectral distribution region including the local peak closer to the half and a method wherein the bottom where the amplitude is the lowest is found between the adjacent two local peaks, and the frequency of the bottom is used as a boundary of the adjacent spectrum distribution regions. FIG. 8B shows an example of the former method wherein the spectrum distribution regions $R_1$, $R_2$, $R_3$ . . . are respectively assigned to the local peaks $P_1$, $P_2$, $P_3$ . . .

At Step 52, a phase spectrum data that represents the phase spectrum distribution in each spectrum distribution depending on the frequency axis by each frames based on the phase spectrum is generated, and it is stored in a predetermined region in the RAM 16. In FIG. 10A, the amplitude spectrum distribution and the phase spectrum distribution in one frame in one spectrum distribution region are respectively shown with curves $AM_1$ and $PH_1$.

At Step 54, a pitch data, an amplitude spectrum data and a phase spectrum data are stored in a voice synthesis unit database by each voice synthesis unit. The RAM 16 or the external storage device 22 can be used as a voice synthesis unit database.

Figure 3:
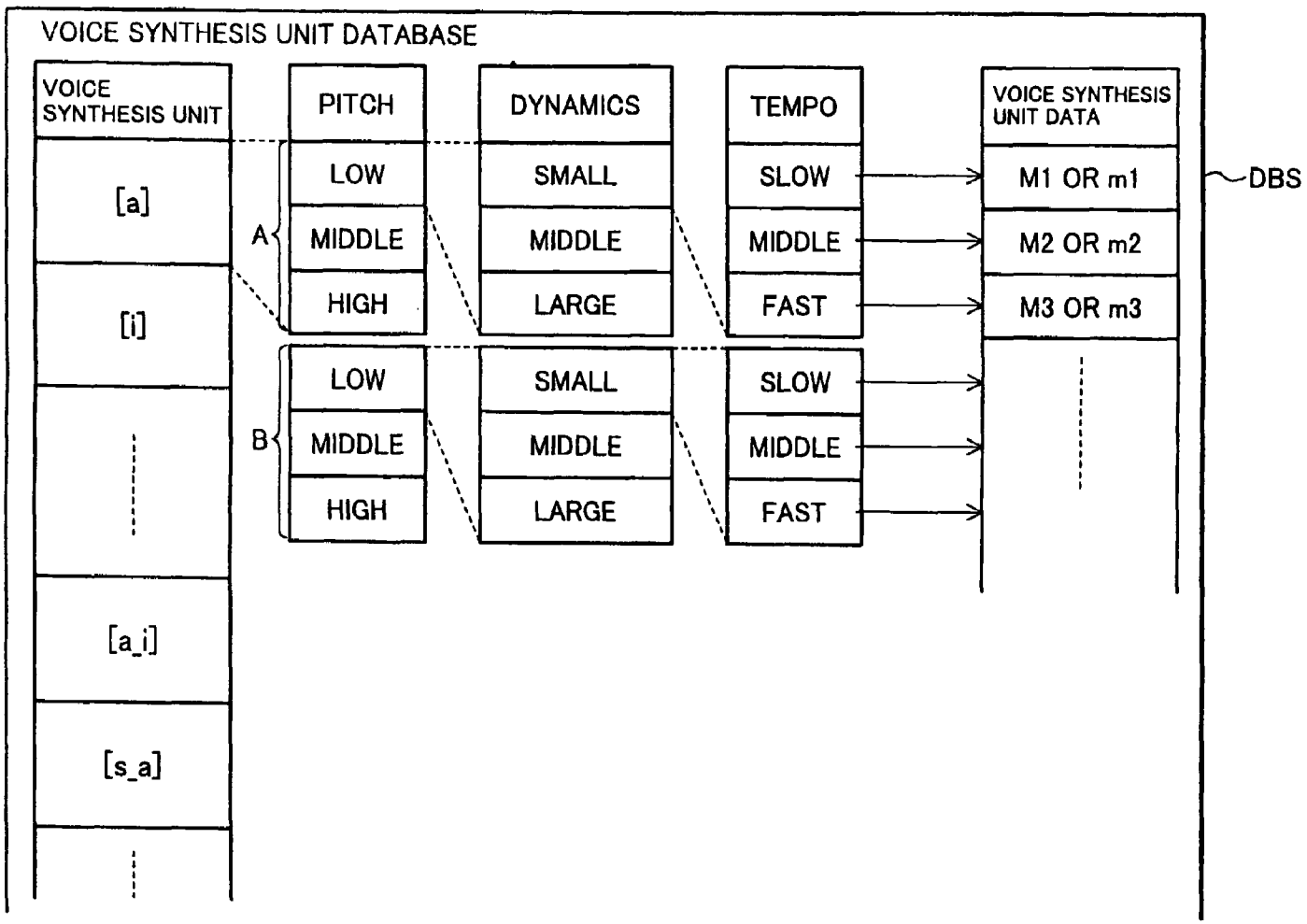
FIG. 3 is a diagram showing a state of a storing in a voice synthesis unit database.

FIG. 3 shows an example of a state of a storing in a voice synthesis unit database DBS. Voice synthesis unit data each corresponding to a single phoneme such as [a], [i], etc., and voice synthesis unit data each corresponding to a phonemic chain such as [a_i], [s_a], etc. are stored in the database DBS. At Step 54, the pitch data, the amplitude spectrum data and the phase spectrum data are stored as voice synthesis unit data.

At a time of storing the voice synthesis unit data, by storing the voice synthesis unit data, each having difference in a singer (a musical tone), the pitch classification, the dynamics classification, the tempo classification and the like from other voice synthesis units, a natural (or high quality) singing voice can be synthesized. For example, for voice synthesis unit [a], voice synthesis unit data M1, M2 and M3 respectively corresponding to the tempo classifications "slow", "middle", and "fast" while the pitch classification is "low" and the dynamics classification is "small" are recorded by having a singer A sing in all the combination of the tempo classifications "slow", "middle", "fast", the pitch classifications "high", "middle", "low" and the dynamics classifications "large", "middle", "small". The voice synthesis unit data corresponding to the other combinations are recorded in the same way. The pitch data generated at Step 46 is used when it is judged to which of "low", "middle" and "high" of the pitch classification the voice synthesis unit data is belonging.

As for a singer B who has a different voice from the singer A, a multiplicity of the voice synthesis units are recorded in the database DBS with different pitch classifications, dynamics classifications and pitch classifications by having the singer B sing similar to the above described singer A. Also, voice synthesis units other than [a] are recorded in the same manner as described above.

Although the voice synthesis unit data are generated in accordance with the singing voice signal input from the input unit 17 in the above-described example, the singing voice signal can be input via the interface 30 or 32, and the voice synthesis unit data can be generated in accordance with the input voice signal. Moreover, the database DBS can be stored not only in the RAM 16 or the external storage unit 22 but also in the ROM14, a storage unit of the MIDI device 36, a storage unit of the computer 38, etc.

Figure 4:
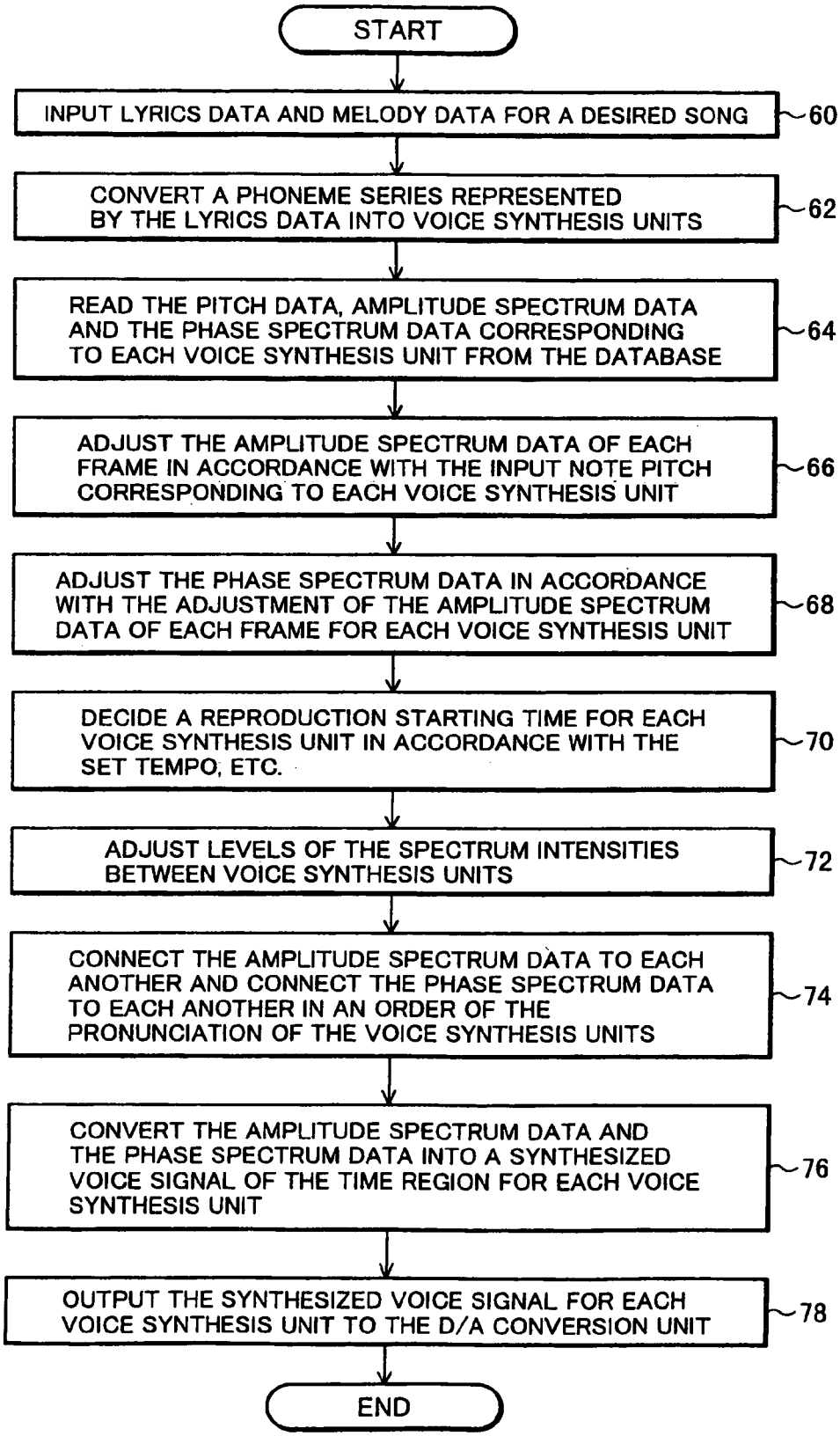
FIG. 4 is a flow chart showing an example of a singing voice synthesizing process.

FIG. 4 shows an example of a singing voice synthesizing process. At Step 60, lyrics data and melody data for a desired song are input from the input unit 18 and are stored into the RAM 16. The lyrics data and the melody data can be also input via the interface 30 or 32.

At Step 62, a phoneme series corresponding to the input lyrics data is converted into individual voice synthesis units. Thereafter, at Step 64, voice synthesis unit data (pitch data, amplitude spectrum data and phase data) corresponding to each voice synthesis units are read from the database DBS. At Step 64, a tone color, a pitch classification, a dynamics classification, a tempo classification, etc. may be input from the input unit 20 as control parameters, and voice synthesis unit data corresponding to the control parameters directed by the data.

By the way, duration of the pronunciation of the voice synthesis unit is corresponding to the number of the voice synthesis unit data. That is, when the voice synthesizing is executed by using the voice synthesis unit data to be stored without changing, the duration of the pronunciation corresponding to the number of the voice synthesis unit data can be obtained. However, the duration of the pronunciation may be inappropriate depending on a duration of the musical note (an input musical note length), a set tempo and the like, and changing the duration of pronunciation will be necessary. In order to satisfy this necessity, the number of read frames of the voice synthesis unit data may be controlled corresponding to the input note length, the set tempo and the like.

For example, in order to shortening the duration of the pronunciation of the voice synthesis unit, the voice synthesis unit data is read skipping a part of frames. Also, in order to lengthening the duration of the pronunciation of the voice synthesis unit, voice synthesis unit data is read repeatedly. Moreover, when a long sound of a single phoneme such as is synthesized, the duration of the pronunciation tends to be changed. Synthesizing the long sound is explained later with reference to FIGS. 14 to 16.

At Step 66, the amplitude spectrum data of each frame is adjusted corresponding to a pitch of the input musical note corresponding to each voice synthesis unit. That is, the amplitude spectrum distribution that the amplitude spectrum data represents by each spectrum distribution region is moved on the frequency axis to be a pitch corresponding to the input musical note pitch.

Figure 10B:
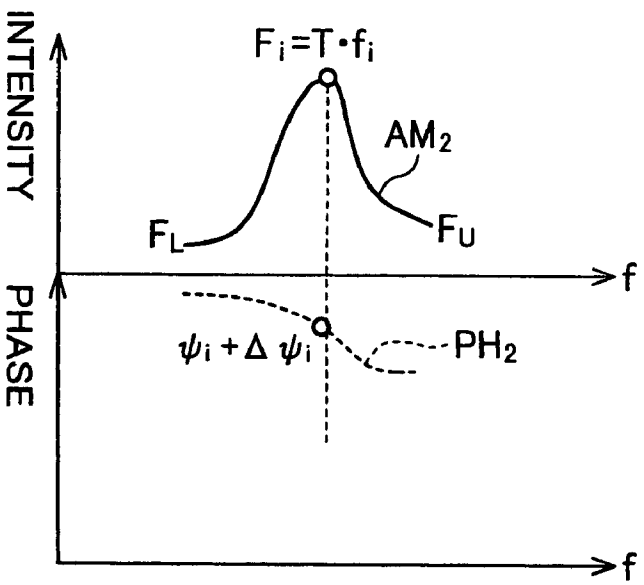
FIG. 10B is a graph showing a distribution of the amplitude spectrum and the phase spectrum after the pitch-shift.
Figure 10A:
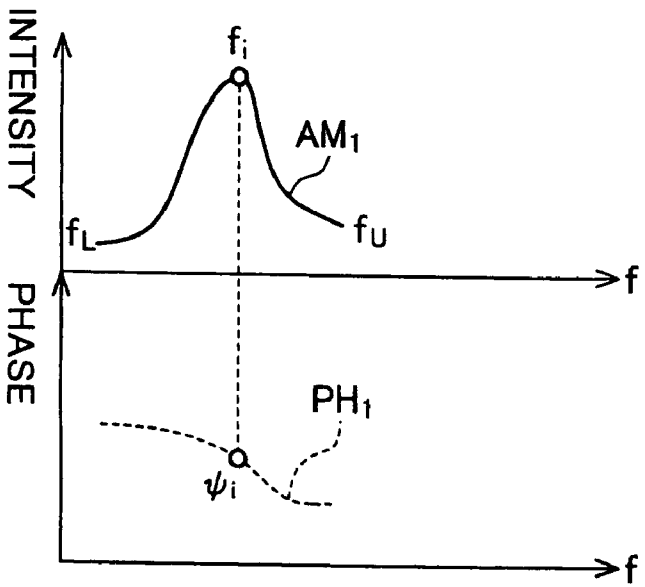
FIG. 10A is a graph showing a distribution of an amplitude spectrum and a phase spectrum before the pitch-shift.

FIGS. 10A and 10B show an example of moving the spectrum distribution region $AM_1$ to the region $AM_2$ for rising the pitch of the spectrum distribution region with a local peak frequency of fi and the lower and the upper limit frequencies are $f_l$ and $f_u$.

In this case, as for the spectrum distribution $AM_2$, the frequency of the local peak is $F_i$=T,$f_i$, and a pitch conversion ratio is called $T=F_i/f_i$. Also, the lower limit frequency $F_i$ and the upper limit Fu are decided corresponding to each frequency difference "$f_i-f_i$" and "$f_u-f_i$".

Figures 9A, 9B:
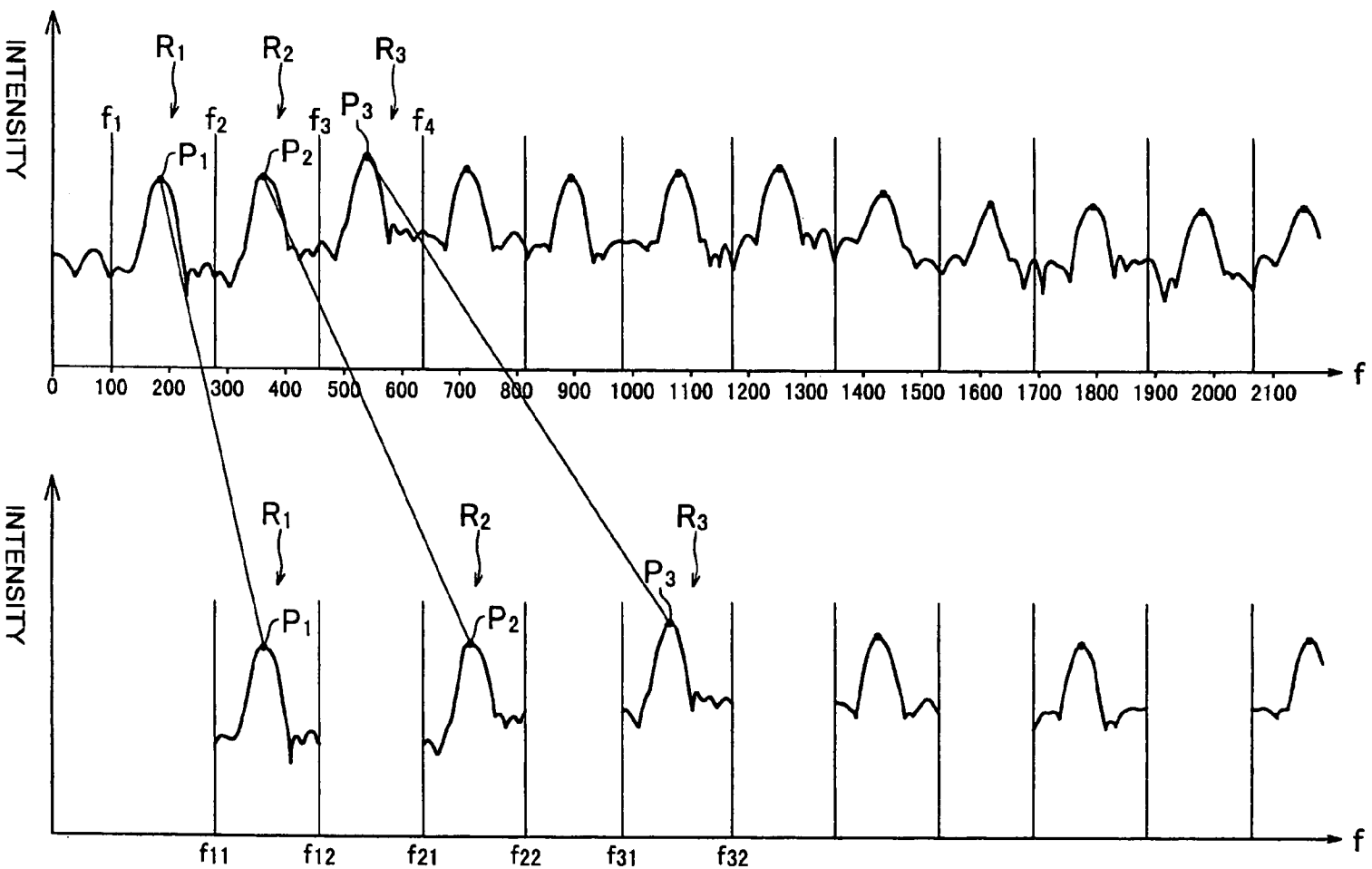
FIG. 9A is a spectrum figure showing region point of a spectrum distribution before a pitch-shift.
FIG. 9B is a spectrum figure showing region point of a spectrum distribution after the pitch-shift.

FIG. 9A shows the spectrum distribution regions $R_1$, $R_2$, $R_3$ (same as shown in FIG. 8B) respectively having the local peaks $P_1$, $P_2$, $P_3$, and FIG. 9B shows an example of moving the spectrum distribution regions toward the higher note in a direction of the frequency axis. In a spectrum distribution region $R_1$ shown in FIG. 9B, the frequency, the lower limit frequency $f_{11}$ and the upper limit frequency $f_{12}$ of the local peak $P_1$ are decided as same as the same method with reference to FIG. 10 described in the above. It also can be applied to other spectrum distribution region.

In the above-described example, however, the spectrum distribution is moved toward the higher pitch side on the frequency axis to rise the pitch, it can be moved toward the lower pitch side on the frequency axis to lower the pitch. In this case, two spectrum distribution regions Ra and Rb are partly overlapped as shown in FIG. 11.

Figure 11:
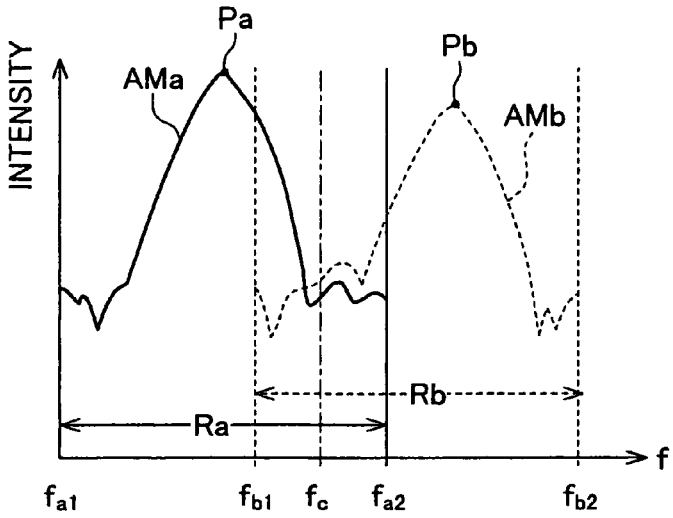
FIG. 11 is a graph to explain a designating process of a spectrum distribution region in a case that a pitch is lowered.

In an example in FIG. 11, the local peak Pb and the spectrum distribution region Pb that has a lower limit frequency $f_{b1}$ ($f_{b1}<f_{a2}$) and the upper limit frequency $f_{b2}$ ($f_{b2}>f_{a2}$) to the spectrum distribution region Ra are overlapped in frequency regions $f_{a1}$ to $f_{a2}$. In order to avoid this kind of situation, for example, the frequency regions $f_{b1}$ to $f_{a2}$ are divided into two by a central frequency, the upper frequency $f_{a2}$ in the region Ra is converted to a predetermined frequency that is lower than the $f_c$, and the lower frequency $f_{b1}$ in the region Rb is converted to a predetermined frequency that is higher than the $f_c$. As a result, in the region Ra, a spectrum distribution AMa can be used in a frequency region that is lower than the $f_c$, and in the region Rb, a spectrum distribution AMa can be used in a frequency region that is higher than the $f_c$.

As described in the above, when the spectrum distribution that includes the local peak is moved on the frequency axis, the spectrum envelope stretches and shortens only by changing the frequency setting, and a problem that the musical tone is different from the input voice waveform arises. In order to reproduce the musical tone of the input voice waveform, it is necessary that the spectrum intensity of local peaks of one or plurality of the spectrum distribution region is adjusted along with the spectrum envelope corresponding to a linked line with the local peaks of a series of spectrum distribution region by each frame.

Figure 12A:
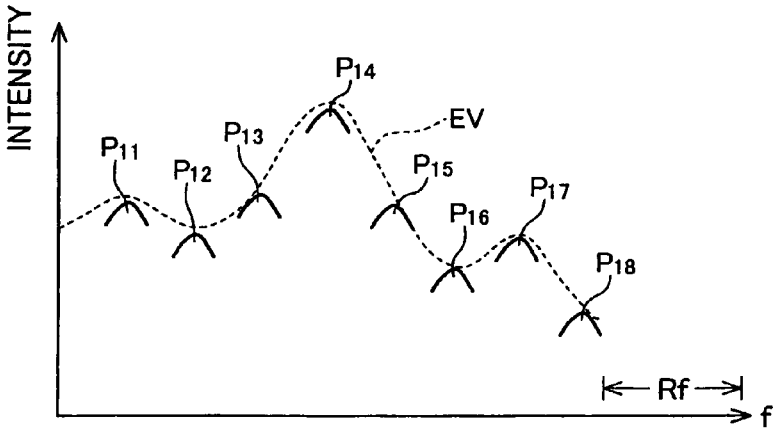
FIG. 12A is a graph showing a local peak point and a spectrum envelope before the pitch-shift.
Figure 12B:
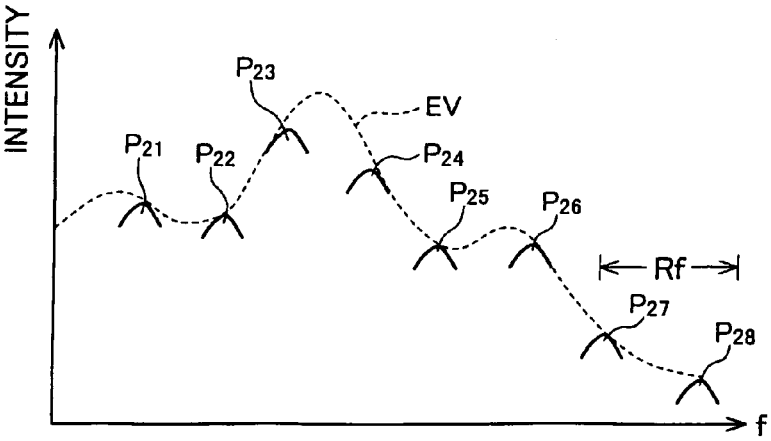
FIG. 12B is a graph showing the local peak point and a spectrum envelope after the pitch-shift.

FIG. 12 shows an example of the spectrum intensity adjustment, and FIG. 12A shows a spectrum envelope EV corresponding to local peaks $P_{11}$ to $P_{18}$ before the pitch-shift. In order to rise the pitch in proportion to the input musical note pitch, the spectrum intensity is increased or decreased to be along with the spectrum envelope to the spectrum envelope EV at a time that the local peaks $P_{11}$ to $P_{18}$ are moved on the frequency axis as shown in $P_{21}$ to $P_{28}$ in FIG. 12B. As a result, a musical tone that is same as the input voice waveform can be obtained.

In FIG. 12A, Rf is a frequency region lacked with the spectrum envelope. When the pitch is raised, transferring the local peaks such as $P_{27}$, $P_{28}$ and the like to the frequency region Rf as shown in FIG. 12B may be necessary. In order to avoid this kind of situation, the spectrum envelope of the frequency region Rf is obtained by an interpolation method as shown in FIG. 12B, and the spectrum intensity of the local peak is adjusted according to the obtained spectrum envelope EV.

In the above-described example, however, musical tone of the input voice waveform is reproduced, a musical tone that is different from the input voice waveform may be added on the synthesizing voice. By doing this, the spectrum intensity may be adjusted by using the spectrum envelope that the spectrum envelope EV shown in FIG. 12 is transformed or a new spectrum envelope.

Figure 13:
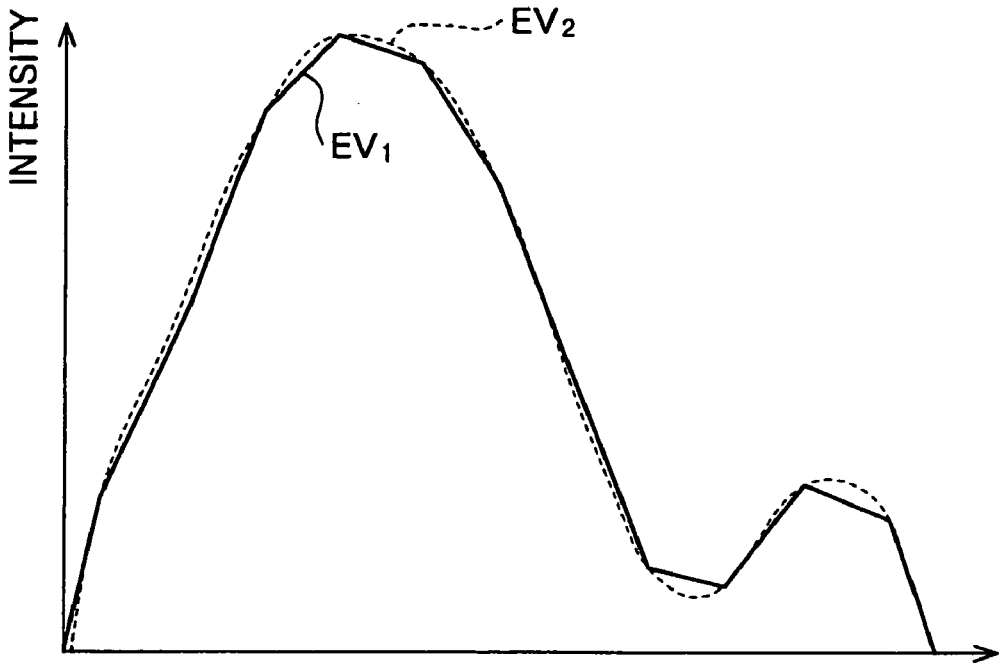
FIG. 13 is a graph showing an example of a spectrum envelope curve.

In order to simplify a process using the spectrum envelope, the spectrum envelope is preferably expressed with a curve or a straight line. FIG. 13 shows two kinds of spectrum envelope curves $EV_1$ and $EV_2$. The curve $EV_1$ simply expresses the spectrum envelope with a line graph by linking each of local peaks by a straight line. Also, the curve $EV_2$ expresses the spectrum envelope by a cubic spline function. When the curve $EV_2$ is used, the interpolation can accurately be executed.

Next, at Step 68 in FIG. 4, the phase spectrum data is adjusted by each voice synthesis unit corresponding to the adjustment of the amplitude spectrum data of each frame. That is, in a spectrum distribution region that includes ith local peak in a frame as shown FIG. 10A, a phase spectrum distribution $PH_1$ is corresponding to an amplitude distribution $AM_1$. When the amplitude spectrum distribution $AM_1$ is moved as $AM_2$ at Step 66, it is necessary that the phase spectrum distribution $PH_1$ is adjusted corresponding to the amplitude spectrum distribution $AM_2$. This is for making the phase spectrum distribution $PH_1$ a sine wave at a frequency at a local peak of a target place of the moving.

When a time interval between the frames is Δt, a local peak frequency is $f_i$, and a pitch conversion ratio is T, a phase interpolation amount $\Delta\psi_1$ related to the spectrum distribution region that contains ith local peak is provided with a following equation A1.

$$\Delta\psi_i = 2\pi f_i (T-1)\Delta t \qquad (A1)$$

The interpolation amount $\Delta\psi_i$ that is obtained by the equation A1 is added to a phase of each phase spectrum in the regions $F_i$ to $F_u$ as shown in FIG. 10B, and the phase at a frequency $F_i$ of the local peak is $\psi_i+\Delta\psi_i$.

The phase interpolation as described in the above is executed for each spectrum distribution region. For example, in one frame, in the case that the frequency of the local peak is perfectly in a harmonic relation (the harmonic frequency is an absolute integral multiple of the fundamental frequency), the fundamental frequency of the input voice (that is, the pitch that the pitch data in the voice synthesis unit data represents) is $f_o$. When numbers of the spectrum distribution region are k=1, 2, 3, . . . , the phase interpolation amount $\Delta\omega_i$ is provided with a following equation A2.

$$\Delta\psi_i = 2\pi f_o k (T-1)\Delta t \qquad (A2)$$

At Step 70, a reproduction starting time is decided corresponding to the set tempo and the like by each voice synthesis unit. The reproduction starting time depends on the set tempo and the input musical note length and can be represented with a clock count of the tempo clock signal TCL. As an example, in the case of the singing voice [saita], the reproduction starting time of the voice synthesis unit [s_a] is set in order to start [a] other than [s] at a note-on time that is decided by the input musical note length and the set tempo. At Step 60, the lyrics data and the melody are input on real time base. When the singing voice synthesizing is executed on real time base, the lyrics data and the melody data are input before the note-on time in order to be possible to set the reproduction starting time described in the above.

At Step 72, a spectrum intensity level can be adjusted between the voice synthesis units. This level adjustment process is executed for both of the amplitude spectrum data and the phase spectrum data, and it is executed for preventing a noise generated at a time of a synthesizing voice generation with a data connection at a next Step 74. There are a smoothing process, a level adjustment process and the like as a level adjustment process, and these processes are explained later referring to FIGS. 17 to 20.

At Step 74, the amplitude spectrum data are connected to each another, and the phase spectrum data are connected to each another. Then, at Step 76, the amplitude spectrum data and the phase spectrum data are converted to a synthesized voice signal (a digital waveform data) of the time region by each voice synthesis unit.

Figure 5:
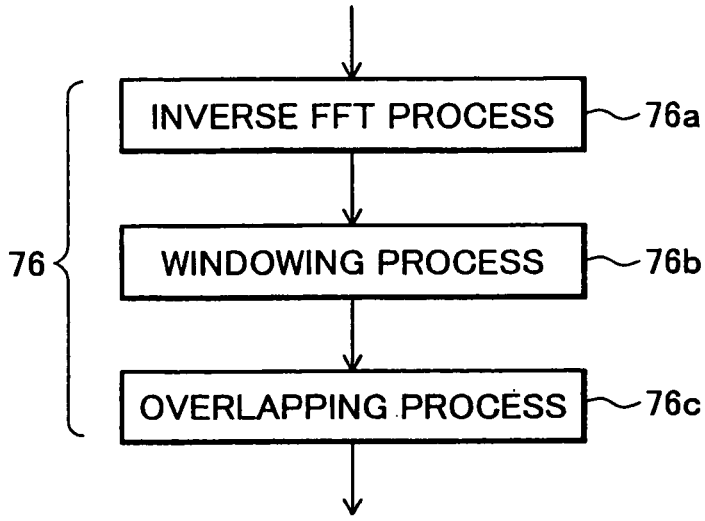
FIG. 5 is a flow chart showing an example of a conversion process at Step 76 in FIG. 4.

FIG. 5 shows an example of a conversion process at Step 76. At Step 76*a*, a reverse FFT process is executed on the frame data (the amplitude spectrum data and the phase spectrum data) of the frequency region to obtain the synthesized voice signal of the time region. Then, at Step 76*b*, a windowing process is executed on the synthesized voice signal of the time region. In this process, a time windowing function is multiplied on the synthesized voice signal of the time region. At Step 76*c*, an overlapping process is executed on the synthesized voice signal of the time region. In this process, the synthesized voice signal of the time region is connected by overlapping the waveform of the voice synthesis unit in an order.

At Step 78, the synthesized voice signal is output to the D/A converting unit 28 referring to the reproduction starting time decided at Step 78. As a result, the singing voice is generated to be synthesized from the sound system 34.

Figure 6:
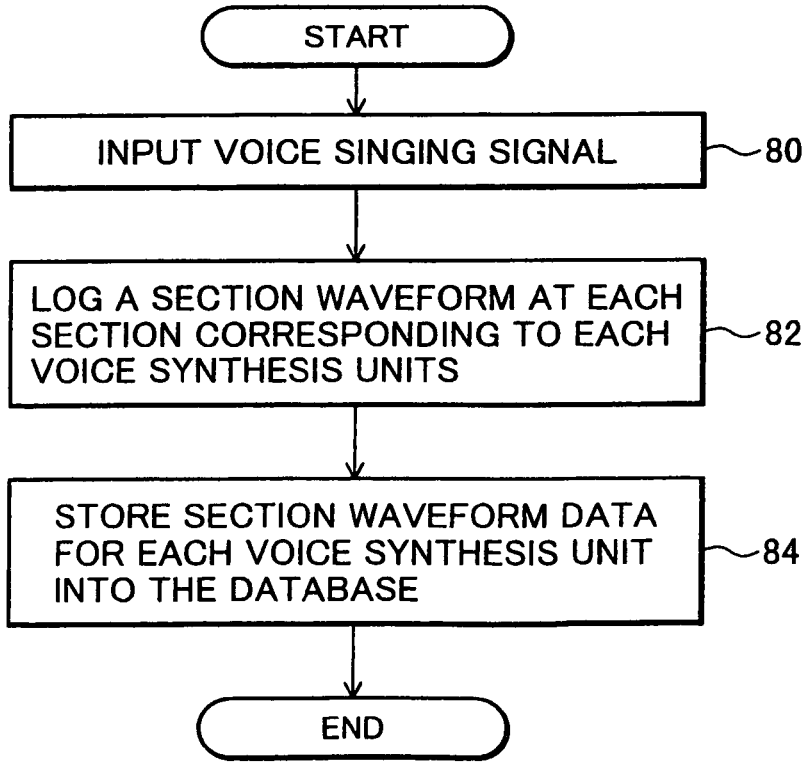
FIG. 6 is a flow chart showing another example of the singing voice analyzing process.

FIG. 6 shows another example of the singing voice analyzing process. At Step 80, the singing voice signal is input as same way as that is described before with reference to Step 40, and the digital waveform data that represents the voice waveform of the input signal is stored in the RAM 16. The singing voice signal may be input via the interface 30 or 32.

At Step 82, a section waveform is logged by each section corresponding to the voice synthesis unit for the digital waveform data to be stored as same way as that is described before with reference to Step 42.

At Step 84, a section waveform data (the voice synthesis unit data) that represents the section waveform by each voice synthesis unit is stored in the voice synthesis unit database. The RAM 16 and the external storage unit 22 can be used as the voice synthesis unit database, and The ROM 14, a storing device in the MIDI device 36 and the storing device in the computer 38 may be used depending on a request. At a time of storing the voice synthesis unit data, section waveform data m1, m2, m3 . . . which are different in the singer (the musical tone), the pitch classification, the dynamics classification and the tempo classification by each voice synthesis unit can be stored in the voice synthesis unit database DBS as same way as that is described before with reference to FIG. 3.

Figure 7:
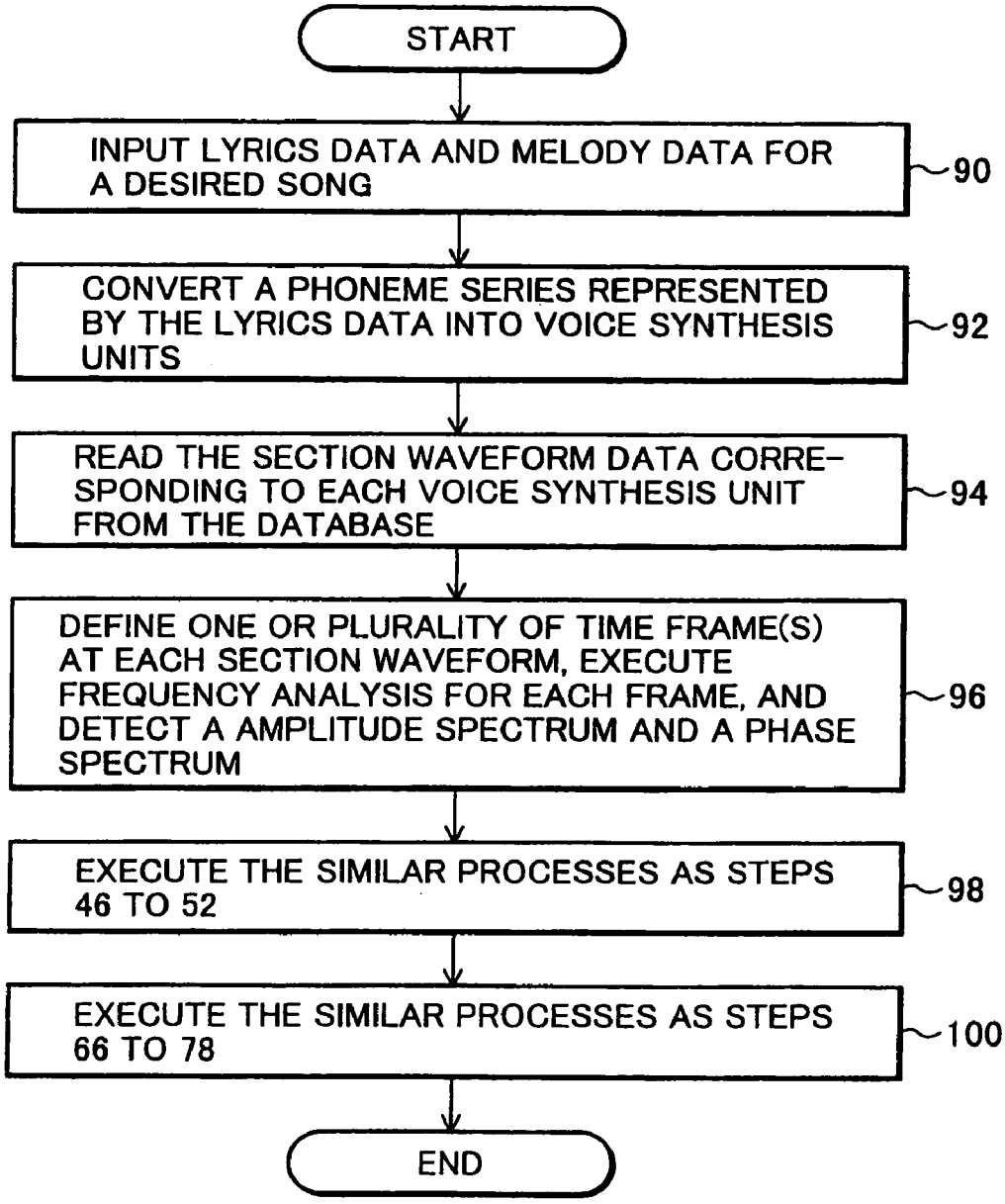
FIG. 7 is a flow chart showing another example of the singing voice synthesizing process.

Next, another example of the singing voice synthesizing process is explained referring to FIG. 7. At Step 90, the lyrics data and the melody data corresponding to the desired singing voice are input as same way as that is described before with reference to Step 60.

At Step 92, the phonemic series that the lyrics data represents is converted to individual voice synthesis unit as same way as that is described before with reference to Step 62. Then at Step 94, the section waveform data (the voice synthesis unit data) corresponding to each voice synthesis unit is read from the database that is executed the storing process at Step 84. In this case, data such as the musical tone, the pitch classification, the dynamics classification and the tempo classification are input as a control parameter from the input unit 20, and the section waveform data corresponding to the control parameter that the data instructs may be read. Also, the duration of pronunciation of the voice synthesis unit may be changed corresponding to the input musical note length and the set tempo as same way as that is described before with reference to Step 64. For doing this, when the voice waveform is read, reading the voice waveform may be continued only for a desired duration of pronunciation by omitting a part of the voice waveform or repeating a part or whole of the voice waveform.

At Step 96, one or plurality of time frames are decided for the section waveform by each section waveform data to be read, and the frequency analysis is executed by each frame by the FFT and the like to detect the frequency spectrum (the amplitude spectrum and the phase spectrum). Then data that represents the frequency spectrum is stored in a predetermined region in the RAM 16.

At Step 98, the same processes as Steps 46 to 52 in FIG. 2 are executed to generate the pitch data, the amplitude spectrum data and the phase spectrum data by each voice synthesis unit. Then at Step 100, the same processes as Steps 66 to 78 in FIG. 4 are executed to synthesize the singing voice and reproduce it.

The singing voice synthesizing process in FIG. 7 is compared to the singing voice synthesizing process in FIG. 4. In the singing voice synthesizing process in FIG. 4, the pitch data, the amplitude spectrum data and the phase spectrum data by each voice synthesis unit are obtained from the database to execute the singing voice synthesizing. On the other hand, in the singing voice synthesizing process in FIG. 7, the section waveform data by each voice synthesis unit is obtained from the database to execute the singing voice synthesizing. However, they are different from each other in a point described in the above, the procedure of the singing voice synthesizing is substantially the same. According to the singing voice synthesizing in FIG. 4 or FIG. 7, since the frequency analysis result of the input voice waveform is not split into the deterministic component and the stochastic component, the stochastic components is not split and resound. Therefore, a natural (a high qualified) synthesized voice can be obtained. Also, a natural synthesized voice can be obtained as for the voiced fricative and plosive sound.

Figure 14:
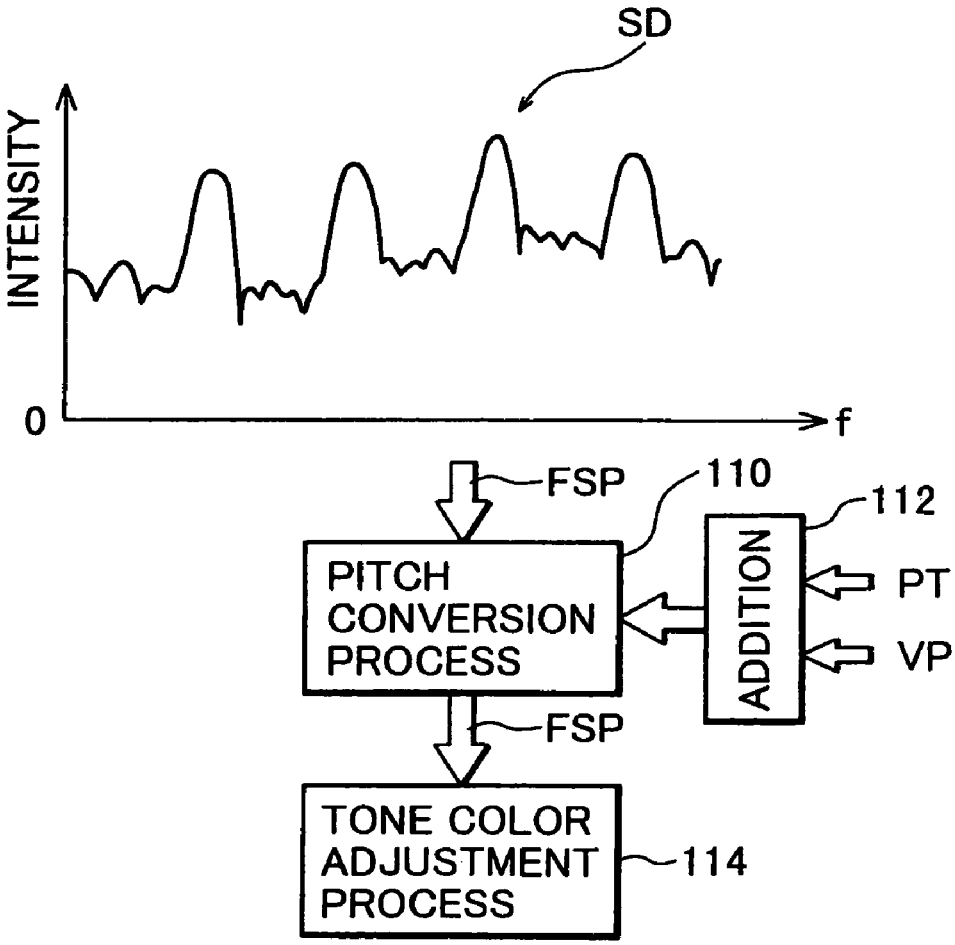
FIG. 14 is a block diagram showing the pitch-shift process and a musical tone adjustment process related to a long sound.

FIG. 14 shows the pitch-shift process and a musical tone adjustment process (corresponding to Step 66 in FIG. 4) related to a long sound of a single phoneme such as [a]. In this case, a data set (a section waveform data) of the pitch data, the amplitude spectrum data and the phase spectrum data shown in FIG. 3 is provided in the database. Also, the voice synthesis unit data that is different in the singer (the musical tone), the pitch classification, the dynamics classification and the tempo classification is stored in the database. When the control parameter such as a desired singer (a desired musical tone), pitch classification, dynamics classification and tempo classification is designated in the input unit 20, the voice synthesis unit data corresponding to the control parameter to be designated is read.

At Step 110, the pitch changing process that is the same as the process at Step 66 is executed on an amplitude spectrum data FSP that is resulted from a long sound voice synthesis unit data SD. That is, the spectrum distribution is moved where a pitch corresponds to the input musical note pitch that the input musical note pitch data PT shows on the frequency axis by each spectrum distribution region of each frame related to amplitude spectrum data FSP.

In the case that the long sound whose duration of the pronunciation is longer than the time length of the voice synthesis unit data SD is required, after reading the voice synthesis unit data SD to the end, the process returns to the start to read again. As doing this, a method to repeat the reading in a time sequential order can be adapted depending on a necessity. As another method, the voice synthesis unit data SD is read from the end to the start after it is read to the end, and a method to repeat the reading in a time sequential order and the reading in a time reverse order depending on the necessity may be adapted. In this method, a reading starting point at a time of the reading in a time reverse order may be set randomly.

In the database DBS shown in FIG. 3 in the pitch changing process at Step 110, for example, a pitch throb data that represents a time sequential pitch change is stored corresponding to each of a long voice synthesis unit data M1 (or m1), M2 (or m2) and M3 (or m3), etc. such as [a]. In this case, at Step 112, the pitch throb data VP to be read is added on the input musical note pitch, and the pitch changing at Step 110 is controlled corresponding to the pitch controlling data as addition result. By doing this, the pitch throb (for example, the pitch bend, vibrato and the like) can be added on the synthesized voice to obtain a natural synthesized voice. Also, since a style of a pith throb can be altered corresponding to the control parameters such as the musical tone, the pitch classification, the dynamics classification and the tempo classification, naturalness is improved. The pitch throb data may be used by modifying one or plurality of pitch throb data corresponding to the voice synthesis unit by interpolation corresponding to the control parameter such as the musical tone and the like.

At Step 114, a musical tone adjustment process is executed on an amplitude spectrum data FSP' that is executed the pitch changing process at Step 110. This process is to set the musical tone of the synthesized voice adjusting the spectrum intensity according to the spectrum envelope by each frame as described before with reference to FIG. 12.

Figure 15:
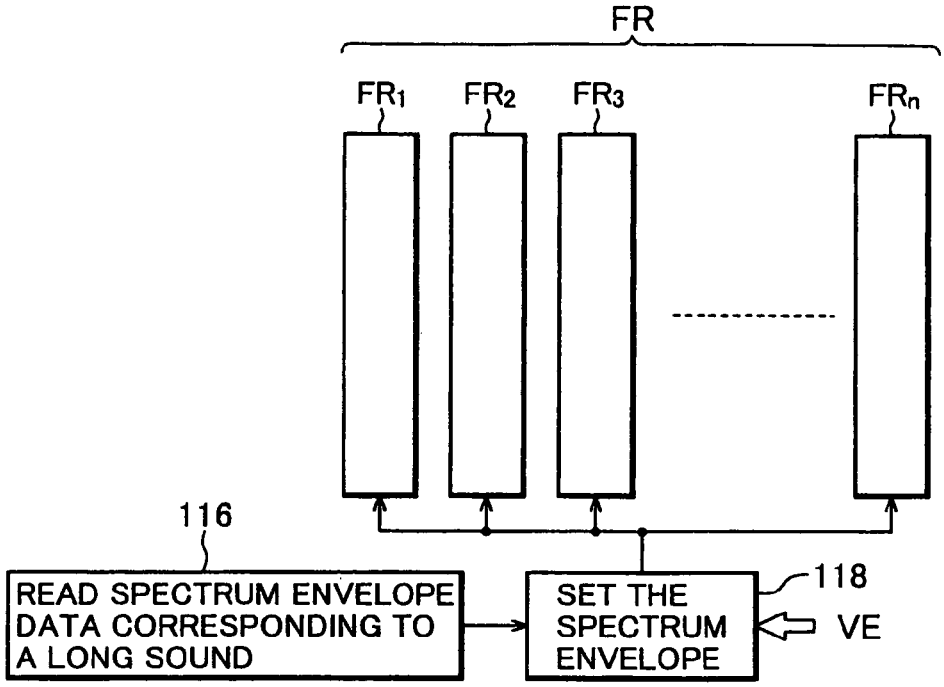
FIG. 15 is a block diagram showing an example of the musical tone adjustment process related to the long sound.

FIG. 15 shows an example of the musical tone adjustment process at Step 114. In this example, for example, the spectrum envelope data that represents one typical spectrum envelope corresponding to the voice synthesis unit of the long sound [a] is stored in the database shown in FIG. 3.

At Step 116, the spectrum envelope data corresponding to the voice synthesis unit of the long sound is read from the database DBS. Then at Step 118, a spectrum envelope setting process is executed based on the spectrum envelope data to be read. That is, the spectrum envelope is set by adjusting the spectrum intensity in order to be along with the spectrum envelope indicated by the spectrum envelope data for each amplitude spectrum data of each frame of plurality of n frames amplitude spectrum data $FR_i$ to $FR_n$ in a frame group FR of long sounds. As a result, an appropriate musical tone can be added on the long sound.

In the spectrum envelope setting process at Step 118, for example, for example, a spectrum envelope throb data that represents a time sequential spectrum envelope change is stored corresponding to each of a long voice synthesis unit data such as M1 (or m1), M2 (or m2) and M3 (or m3) in the database DBS shown in FIG. 3, and the spectrum envelope throb data corresponding to the control parameter to be designated responding to designating the control parameter such as the musical tone, the pitch classification, the dynamics classification and the tempo classification in the input unit 20 may be read. In this case, at Step 118, the spectrum envelope throb data VE to be read is added on the spectrum envelope throb data to be read at Step 116, and the spectrum envelope setting at Step 118 is controlled corresponding to the spectrum envelope controlling data as addition result. By doing this, the musical tone throb (for example, tone bend and the like) can be added on the synthesized voice to obtain a natural synthesized voice. Also, since a style of a pitch throb can be altered corresponding to the control parameters such as the musical tone, the pitch classification, the dynamics classification and the tempo classification, naturalness is improved. The pitch throb data may be used by modifying one or plurality of pitch throb data corresponding to the voice synthesis unit by interpolation corresponding to the control parameter such as the musical tone and the like.

Figure 16:
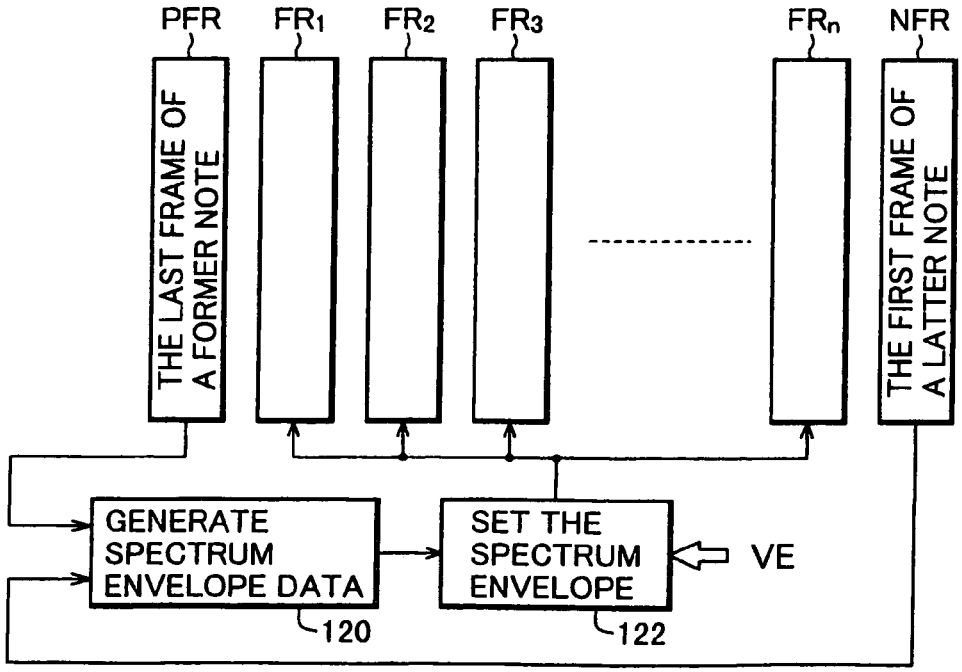
FIG. 16 is a block diagram showing another example of the musical tone adjustment process related to the long sound.

FIG. 16 shows another example of the musical tone adjustment process at Step 114. In the singing voice synthesizing, a singing voice synthesizing of a phoneme series (e.g., [s_a])—a single phoneme (e.g., [a])—a phoneme series (e.g., [a_i]) such as the above described example of singing [saita] is a typical example, and FIG. 16 shows the example of the typical singing voice synthesizing. In FIG. 16, a former note in amplitude spectrum data PFR of the last frame of the former note is corresponding to, for example, the phoneme series [s_a], a long sound of n frames amplitude spectrum data $FR_i$ to $FR_n$ of long sound is corresponding to, for example, the single phoneme [a], and a latter note in amplitude spectrum data PFR of the first frame of the latter note is corresponding to, for example, the phoneme series [a_i].

At Step 120, the spectrum envelope is extracted from an amplitude spectrum data PFR of a last frame of a former note, and the spectrum envelope is extracted from am amplitude spectrum data NFR of a first frame of the latter note. Then two spectrum envelopes to be extracted execute a time interpolation, and a spectrum envelope data that represents a spectrum envelope for a long sound is formed.

At Step 122, the spectrum envelope is set by adjusting the spectrum intensity in order to be along with the spectrum envelope that the spectrum envelope data to be formed at Step 120 indicates for each amplitude spectrum data of each frame of plurality of n frames amplitude spectrum data $FR_i$ to $FR_n$. As a result, an appropriate musical tone can be added on the long sound between the phonemic chains.

Also, at Step 122, the spectrum envelope setting can be controlled by reading the spectrum envelope throb data VE from the database DBS corresponding to the control parameter such as musical tone and the like as same as the before-described process with reference to Step 118. By doing this, a natural synthesized voice can be obtained.

Figure 17:
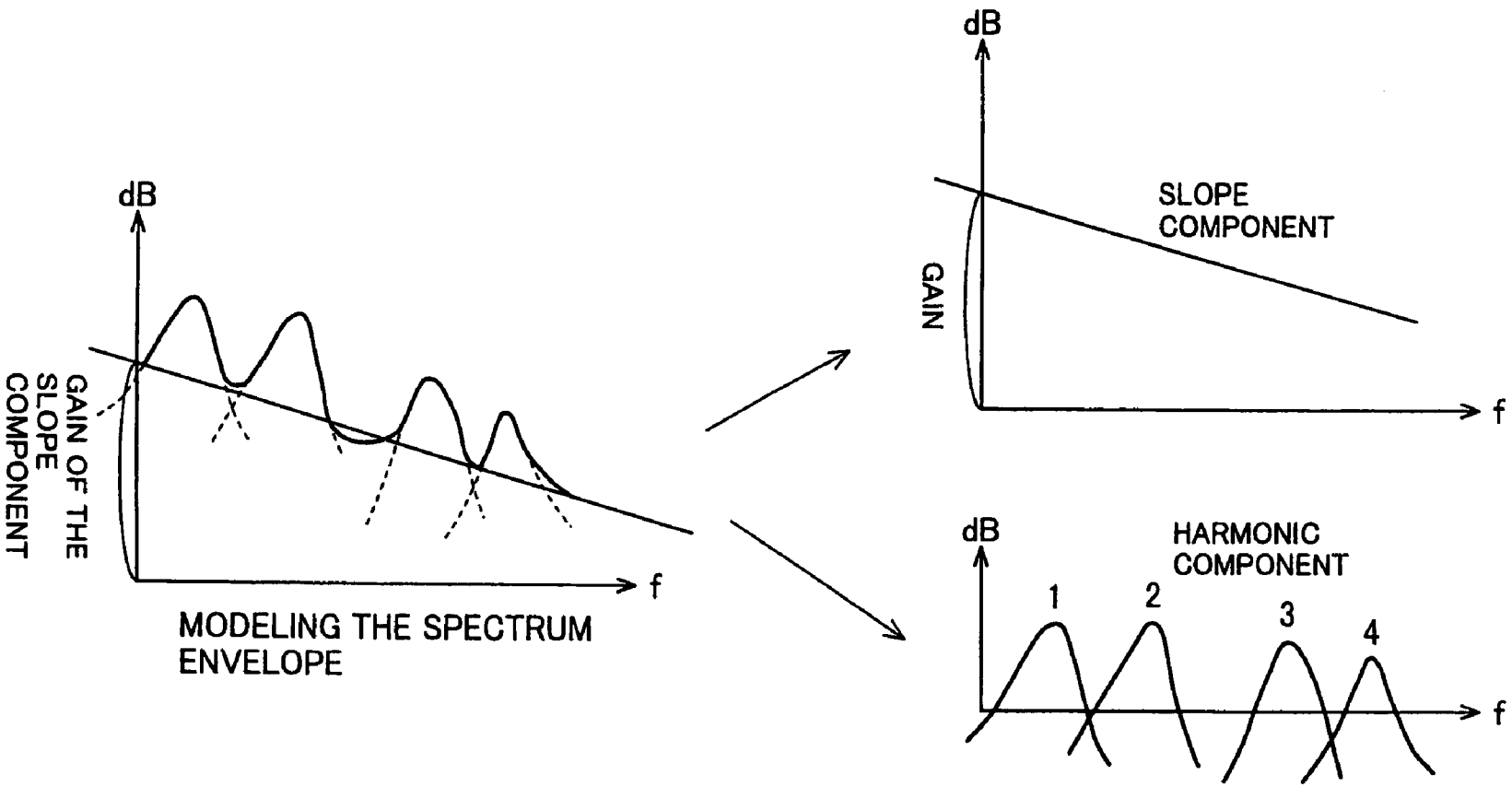
FIG. 17 is a graph to explain a modelizing of the spectrum envelope.
Figure 18:
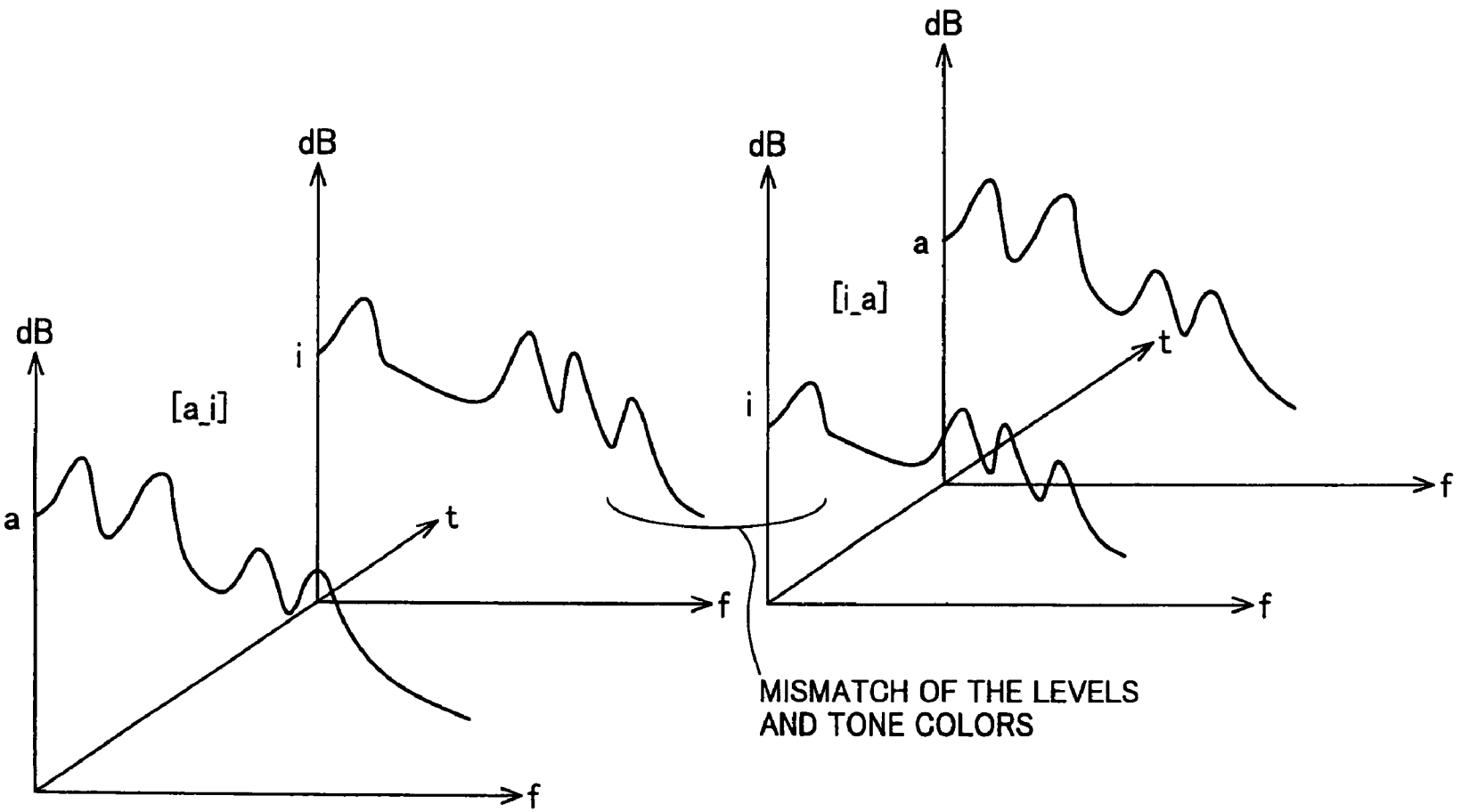
FIG. 18 is a graph to explain miss matching of a level and a musical tone that occur at a time of connection to the voice synthesis unit.
Figure 19:
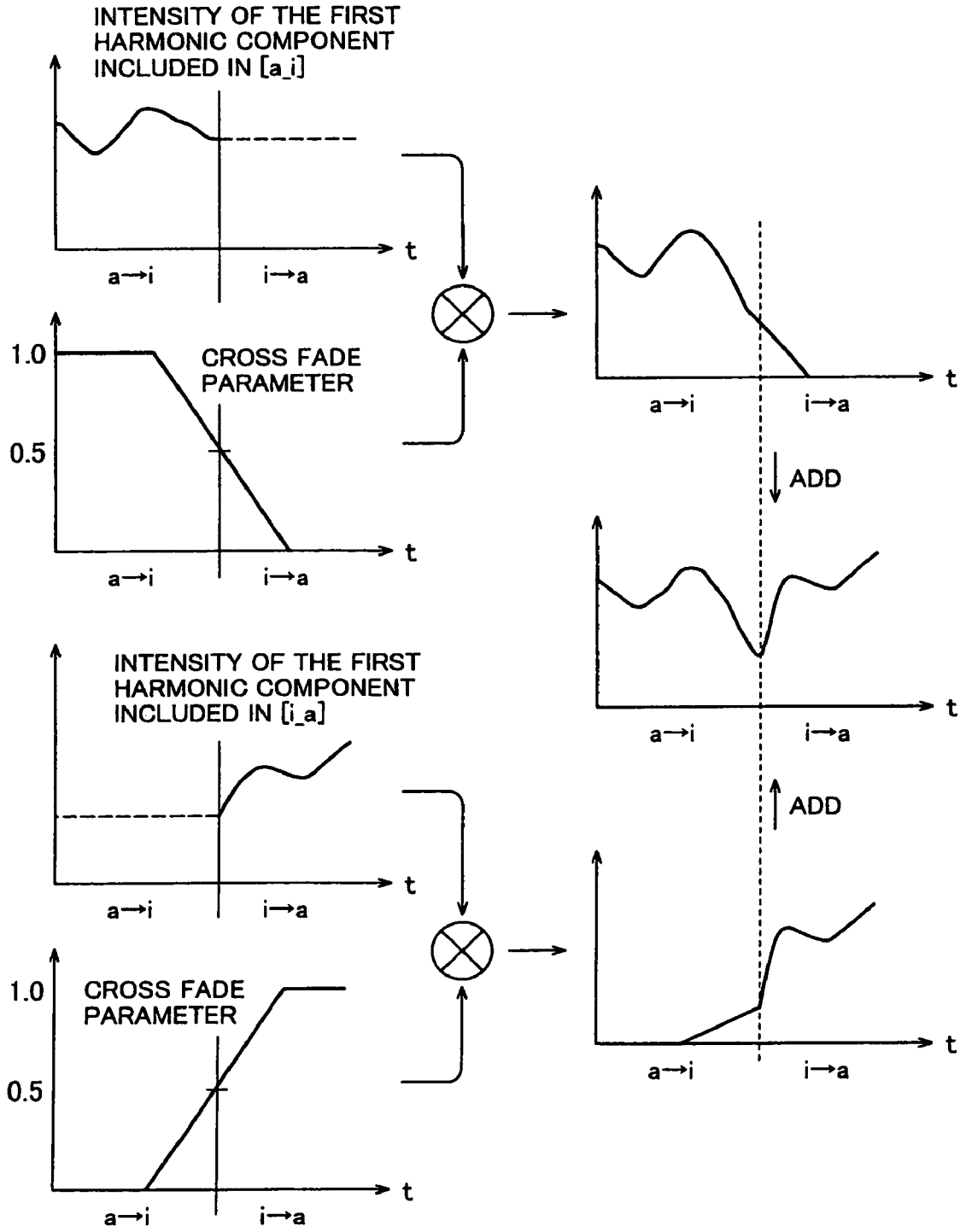
FIG. 19 is a graph to explain a smoothing process.

Next, an example of the smoothing process (corresponding to Step 72) is explained referring to FIGS. 17 to 19. In this example, in order to make data easy to be handled and to simplify a calculation, a spectrum envelope of each frame of a voice synthesis unit is analyzed into a slope component represented by a straight line (or an index function) and one or plurality of harmonic components represented by an index function as shown in FIG. 17. That is, an intensity of the harmonic component is calculated based on the slope component, and the spectrum envelope is represented by adding the slope component and the harmonic component. Also, a value extended the slope component to 0 Hz is called a gain of the slope component.

As an example, two voice synthesis units [a_i] and [i_a] as shown in FIG. 18 are connected each other. Since these voice synthesis units are originally extracted from different recordings, there is a miss matching in musical tones and levels of connecting part [i]. Then, a step of a waveform is formed at the connecting part as shown in FIG. 18, and it is heard as a noise. By cross-fading each parameter of slope components and harmonic components of two voice synthesis unit data with the connecting point as a center from a few frames before or after the center, a step at the connecting point is eliminated and generation of noise can be prevented.

For example, in order to cross fade parameters for harmonic components, as shown in FIG. 19, the parameters for harmonic components of both voice synthesis unit data is multiplied by a function (cross fade parameter) that makes parameters to be 0.5 at the connecting point and the products of the multiplication are added together. In FIG. 19, an example wherein the cross-fading is executed by adding waveforms, each representing time sequential change of intensity of the first harmonic component (based on the slope components) for a voice synthesis unit [a_i] or [i_a] and each waveform is multiplied by the cross fade parameter.

The cross fading can be executed also on parameters such as other harmonic components and slope components as same as the above.

FIG. 20 is an example of the level adjustment process (corresponding to Step 72). In this example, as same as the above, the level adjustment process in the case that [a_i] and [i_a] are connected to synthesize is explained.

In this case, the level adjustment is executed in order to be almost the same amplitudes before and after the connecting point of voice synthesis units instead of cross fading. The level adjustment can be executed by multiplying a certain or a transitional coefficient to the amplitude of the voice synthesis unit.

Figure 20A:
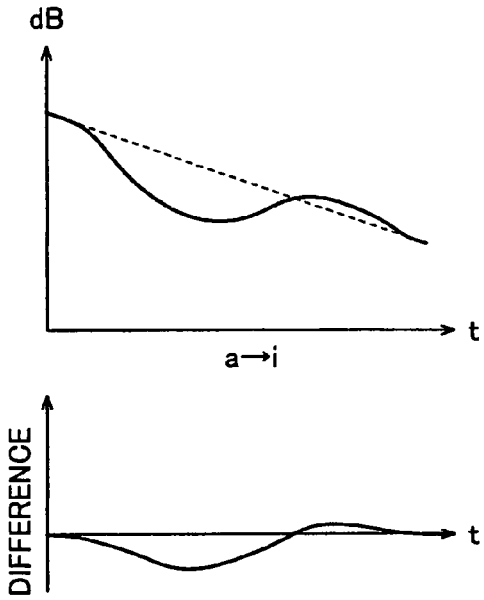
FIG. 20 is a graph to explain a level adjustment process.
Figure 20B:
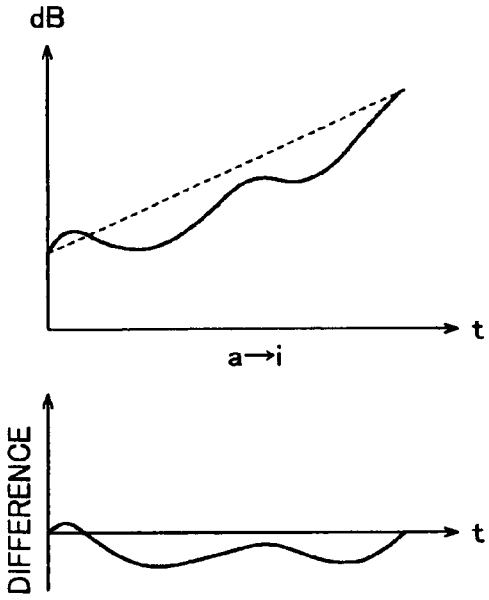

In this example, it is explained that gains of slope components of two voice synthesis units are joined. First, as shown in FIGS. 20A and 20B, for voice synthesis units [a_i] and [i_a], parameters (broken lines in the drawings) are calculated by interpolating gains of slope components between the fist frame and the last frame, and differences between the actual slope components and the interpolated parameters.

Next, typical samples (the slope components and each parameter of the harmonic component) for each of phonemes [a] and [i] are calculated. As the typical samples, the amplitude spectrum data of the first and the last frames of [a_l] can be calculated.

Figure 20C:
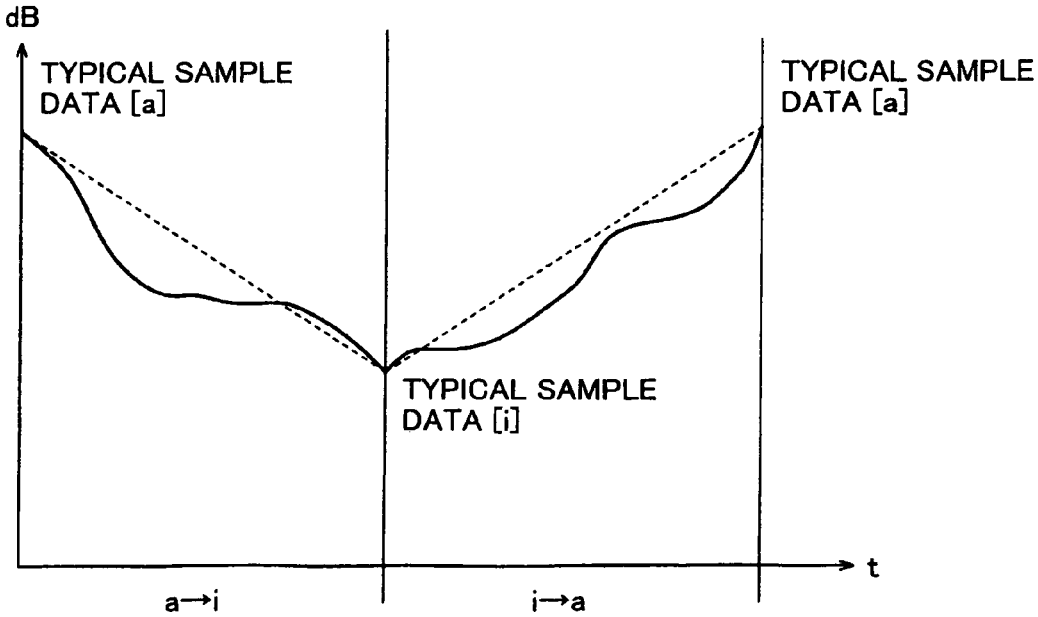
Figure 21:
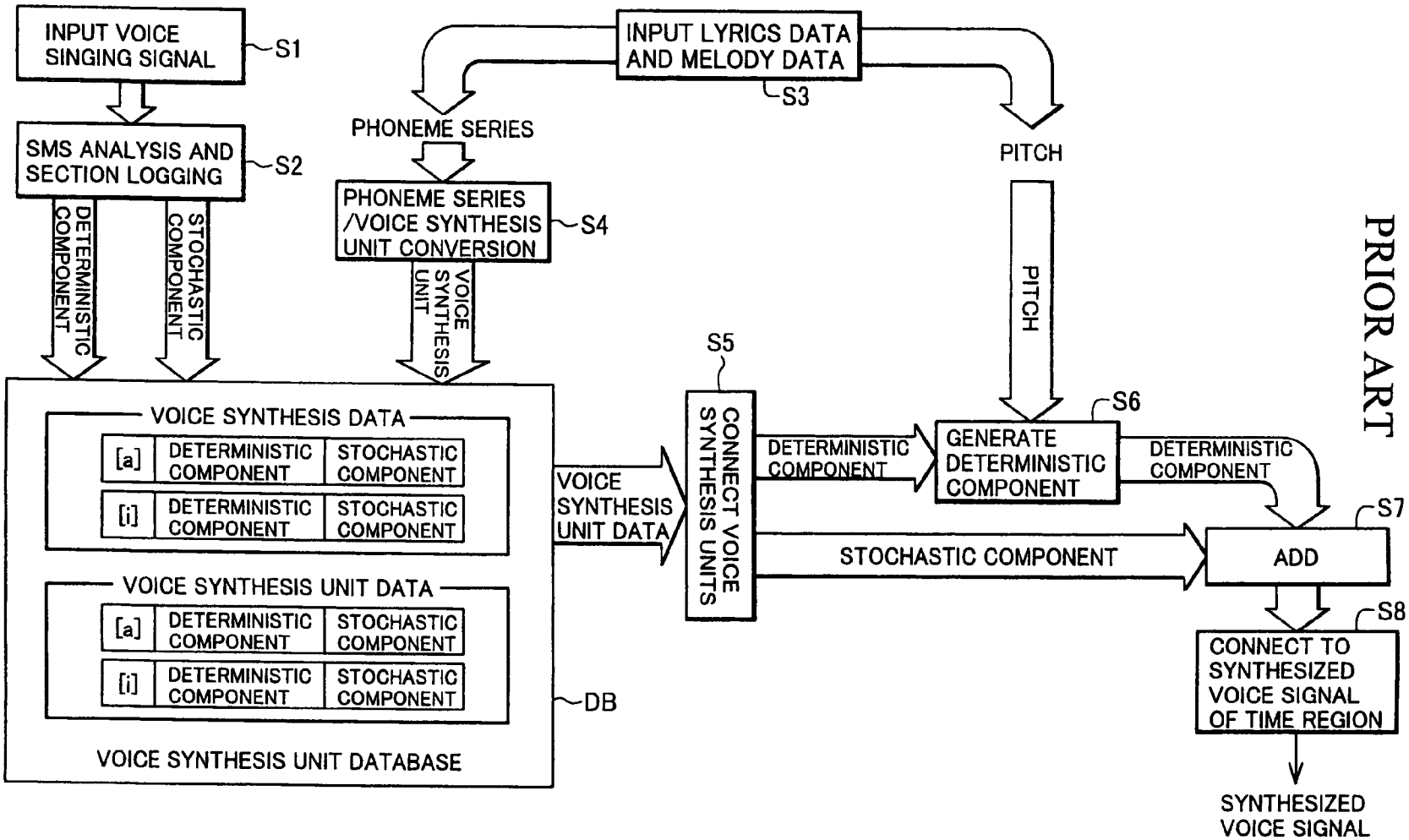
FIG. 21 is a block diagram showing an example of a conventional singing voice synthesizing process.

In accordance with the typical samples of [a] and [i], as indicated by the broken line shown in FIG. 20C, parameters calculated by the linear interpolation of the gains of the slope components between [a] and [i] are obtained, and parameters calculated by the linear interpolation of the gains of the slope components between [i] and [a] are obtained. Next, by adding the differences calculated with FIGS. 20A and 20B respectively to the interpolated parameters, the interpolated parameters are agreed every time at a boundary; therefore, discontinuity of the gains of the slope components is not generated. By the same manner, discontinuity can be prevented for the other parameters such as the parameters of the harmonic component.

At the above described Step 72, the above described smoothing process or level adjustment process is applied not only to the amplitude spectrum data but also to the phase spectrum data for adjustment of phase. As a result, production of noise can be prevented, and high quality singing voice synthesizing can be achieved. Further, in the smoothing process or level adjustment process, although the spectrum intensities are completely agreed at the connecting point, the spectrum intensities can be approximately agreed.

The present invention has been described in connection with the preferred embodiments. The invention is not limited only to the above embodiments. It is apparent that various modifications, improvements, combinations, and the like can be made by those skilled in the art.

What are claimed are:

1. A singing voice synthesizing method, comprising the steps of:

(a) detecting a frequency spectrum by analyzing a frequency of a voice waveform corresponding to a voice synthesis unit of a voice to be synthesized;

(b) detecting a plurality of local peaks of a spectrum intensity on the frequency spectrum;

(c) designating, for each of the plurality of the local peaks, a spectrum distribution region including the local peak and spectrums therebefore and thereafter on the frequency spectrum and generating amplitude spectrum data representing an amplitude spectrum distribution depending on a frequency axis for each spectrum distribution region;

(d) generating phase spectrum data representing a phase spectrum distribution depending on the frequency axis for each said spectrum distribution region;

(e) designating a pitch for the voice to be synthesized;

(f) adjusting, for each said spectrum distribution region, the amplitude spectrum data by moving the amplitude spectrum distribution represented by the amplitude spectrum data along the frequency axis in accordance with the pitch;

(g) adjusting, for each said spectrum distribution region, the phase spectrum distribution represented by the phase spectrum data in accordance with the adjustment of the amplitude spectrum data; and (h) converting the adjusted amplitude spectrum data and the adjusted phase spectrum data into a synthesized voice signal of a time region.

2. A singing voice synthesizing method, comprising the steps of:

(a) obtaining amplitude spectrum data and phase spectrum data corresponding to a voice synthesis unit of a voice to be synthesized, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of the voice synthesis unit, and the phase spectrum data is data representing a phase spectrum distribution depending on the frequency axis for each said spectrum distribution region;

(b) designating a pitch for the voice to be synthesized;

(c) adjusting, for each said spectrum distribution region, the amplitude spectrum data by moving the amplitude spectrum distribution represented by the amplitude spectrum data along the frequency axis in accordance with the pitch;

(d) adjusting, for each said spectrum distribution regions, the phase spectrum distribution represented by the phase spectrum data in accordance with the adjustment of the amplitude spectrum data; and (e) converting the adjusted amplitude spectrum data and the adjusted phase spectrum data into a synthesized voice signal of a time region.

3. A singing voice synthesizing method according to claim 1, wherein the pitch designating step (e) designates the pitch in accordance with pitch throb data representing a variation of the pitch in a time sequence.

4. A singing voice synthesizing method according to claim 3, wherein the pitch throb data corresponds to a control parameter for controlling a musical expression of the voice to be synthesized.

5. A singing voice synthesizing method according to claim 1, wherein the amplitude spectrum data adjusting step (f) adjusts the spectrum intensity of the local peak that is not along with a spectrum envelope corresponding to a line connecting each, of the plurality of the local peaks before the adjustment to be along with the spectrum envelope.

6. A singing voice synthesizing method according to claim 1, wherein the amplitude spectrum data adjusting step (f) adjusts intensity of the local peak that is not along with a predetermined spectrum envelope to be along with the predetermined spectrum envelope.

7. A singing voice synthesizing method according to claim 5, wherein the amplitude spectrum data adjusting step (f) sets the spectrum envelope that varies in a time sequence by adjusting the intensity in accordance with spectrum envelope throb data representing a variation of the spectrum envelope for a time sequence for sequential time frames.

8. A singing voice synthesizing method according to claim 7, wherein the spectrum envelope throb data corresponds to a control parameter for controlling a musical expression of the voice to be synthesized.

9. A singing voice synthesizing apparatus, comprising:

a designating device that designates a voice synthesis unit and a pitch for a voice to be synthesized;

a reading device that reads voice waveform data representing a waveform corresponding to the voice synthesis unit as voice synthesis unit data from a voice synthesis unit database;

a first detecting device that detects a frequency spectrum by analyzing a frequency of the voice waveform represented by the voice waveform data;

a second detecting device that detects a plurality of local peaks of a spectrum intensity on the frequency spectrum;

a first generating device that designates, for each of the plurality of the local peaks, a spectrum distribution region including the local peak and spectrums therebefore and thereafter on the frequency spectrum and generates amplitude spectrum data representing an amplitude spectrum distribution depending on a frequency axis for each spectrum distribution region;

a second generating device that generates phase spectrum data representing a phase spectrum distribution depending on the frequency axis for each said spectrum distribution region;

a first adjusting device that adjusts, for each said spectrum distribution region, the amplitude spectrum data by moving the amplitude spectrum distribution represented by the amplitude spectrum data along the frequency axis in accordance with the pitch;

a second adjusting device that adjusts, for each said spectrum distribution region, the phase spectrum distribution represented by the phase spectrum data in accordance with the adjustment of the amplitude spectrum data; and a converting device that converts the adjusted amplitude spectrum data and the adjusted phase spectrum data into a synthesized voice signal of a time region.

10. A singing voice synthesizing apparatus, comprising:

a designating device that designates a voice synthesis unit and a pitch for a voice to be synthesized;

a reading device that reads amplitude spectrum data and phase spectrum data corresponding to the voice synthesis unit as voice synthesis unit data from a voice synthesis unit database, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of the voice synthesis unit, and the phase spectrum data is data representing a phase spectrum distribution depending on the frequency axis for each said spectrum distribution region;

a first adjusting device that adjusts, for each said spectrum distribution region, the amplitude spectrum data by moving the amplitude spectrum distribution represented by the amplitude spectrum data along the frequency axis in accordance with the pitch;

a second adjusting device that adjusts, for each said spectrum distribution region, the phase spectrum distribution represented by the phase spectrum data in accordance with the adjustment of the amplitude spectrum data; and a converting device that converts the adjusted amplitude spectrum data and the adjusted phase spectrum data into a synthesized voice signal of a time region.

11. A singing voice synthesizing apparatus according to claim 9, wherein the designating device designates a control parameter for controlling a musical expression of the voice to be synthesized, and the reading device reads voice synthesis unit data corresponding to the voice synthesis unit and the control parameter.

12. A singing voice synthesizing apparatus according to claim 9, wherein the designating device designates at least one of a note length or a tempo for the voice to be synthesized, and the reading device continues to read the voice synthesis unit data for a time corresponding to at least one the note length or the tempo by omitting a part of or repeating a part or whole of the voice synthesis unit data.

13. A singing voice synthesizing apparatus, comprising:

a designating device that designates a voice synthesis unit and a pitch for each of the voices to be sequentially synthesized;

a reading device that reads voice waveform data corresponding to each voice synthesis unit designated by the designating device from a voice synthesis unit database;

a first detecting device that detects a frequency spectrum by analyzing a frequency of the voice waveform corresponding to each voice waveform;

a second detecting device that detects a plurality of local peaks of a spectrum intensity on the frequency spectrum corresponding to each said voice waveform;

a first generating device that designates, for each of the plurality of the local peaks for each said voice synthesis unit, a spectrum distribution region including the local peak and spectrums therebefore and thereafter on the frequency spectrum and generates amplitude spectrum data representing an amplitude spectrum distribution depending on a frequency axis for each spectrum distribution region;

a second generating device that generates phase spectrum data representing a phase spectrum distribution depending on the frequency axis for each said spectrum distribution region of each said voice synthesis unit;

a first adjusting device that adjusts, for each said spectrum distribution region of each said voice synthesis unit, the amplitude spectrum data by moving the amplitude spectrum distribution represented by the amplitude spectrum data along the frequency axis in accordance with the pitch;

a second adjusting device that adjusts, for each said spectrum distribution region of each said voice synthesis unit, the phase spectrum distribution represented by the phase spectrum data in accordance with the adjustment of the amplitude spectrum data;

a first connecting device that connects the adjusted amplitude spectrum data to connect sequential voice synthesis units respectively corresponding to the voices to be sequentially synthesized in a pronunciation order, wherein the spectrum intensities are adjusted to be agreed or approximately agreed with each another at connection points of the sequential voice synthesis units;

a second connecting device that connects the adjusted phase spectrum data to connect the sequential voice synthesis units respectively corresponding to the voices to be sequentially synthesized in a pronunciation order, wherein the phases are adjusted to be agreed or approximately agreed with each another at connection points of the sequential voice synthesis units; and a converting device that converts the connected amplitude spectrum data and the connected phase spectrum data into a synthesized voice signal of a time region.

14. A singing voice synthesizing apparatus, comprising:

a designating device that designates a voice synthesis unit and a pitch for each voice to be sequentially synthesized;

a reading device that reads voice waveform data corresponding to each voice synthesis unit designated by the designating device from a voice synthesis unit database, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of each said voice synthesis unit, and the phase spectrum data is data representing a phase spectrum distribution depending on the frequency axis for each said spectrum distribution region;

a first adjusting device that adjusts, for each said spectrum distribution region of each said voice synthesis unit, the amplitude spectrum data by moving the amplitude spectrum distribution represented by the amplitude spectrum data along the frequency axis in accordance with the pitch;

a second adjusting device that adjusts, for each said spectrum distribution regions of each said voice synthesis unit, the phase spectrum distribution represented by the phase spectrum data in accordance with the adjustment of the amplitude spectrum data;

a first connecting device that connects the adjusted amplitude spectrum data to connect sequential voice synthesis units respectively corresponding to the voices to be sequentially synthesized in a pronunciation order, wherein the spectrum intensities are adjusted to be agreed or approximately agreed with each another at connection points of the sequential voice synthesis units;

a second connecting device that connects the adjusted phase spectrum data to connect the sequential voice synthesis units respectively corresponding to the voices to be sequentially synthesized in a pronunciation order, wherein the phases are adjusted to be agreed or approximately agreed with each another at connection points of the sequential voice synthesis units; and a converting device that converts the connected amplitude spectrum data and the connected phase spectrum data into a synthesized voice signal of a time region.

15. A storage medium storing a program for a singing voice synthesizing apparatus, the program when executed causes a computer to:

(a) detect a frequency spectrum by analyzing a frequency of a voice waveform corresponding to a voice synthesis unit of a voice to be synthesized;

(b) detect a plurality of local peaks of a spectrum intensity on the frequency spectrum;

(c) designate, for each of the plurality of the local peaks, a spectrum distribution region including the local peak and spectrums therebefore and thereafter on the frequency spectrum and generating amplitude spectrum data representing an amplitude spectrum distribution depending on a frequency axis for each spectrum distribution region;

(d) generate phase spectrum data representing a phase spectrum distribution depending on the frequency axis for each said spectrum distribution region;

(e) designate a pitch for the voice to be synthesized;

(f) adjust, for each said spectrum distribution regions, the amplitude spectrum data by moving the amplitude spectrum distribution represented by the amplitude spectrum data along the frequency axis in accordance with the pitch;

(g) adjust, for each said spectrum distribution region, the phase spectrum distribution represented by the phase spectrum data in accordance with the adjustment of the amplitude spectrum data; and (h) convert the adjusted amplitude spectrum data and the adjusted phase spectrum data into a synthesized voice signal of a time region.

16. A storage medium storing a program for a singing voice synthesizing apparatus, the program when executed causes a computer to:

(a) obtain amplitude spectrum data and phase spectrum data corresponding to a voice synthesis unit of a voice to be synthesized, wherein the amplitude spectrum data is data representing an amplitude spectrum distribution depending on a frequency axis for each spectrum distribution region for each of a plurality of local peaks of a spectrum intensity including the local peak and spectrums therebefore and thereafter in a frequency spectrum obtained by a frequency analysis of a voice waveform of the voice synthesis unit, and the phase spectrum data is data representing a phase spectrum distribution depending on the frequency axis for each said spectrum distribution region;

(b) designate a pitch for the voice to be synthesized;

(c) adjust, for each said spectrum distribution region, the amplitude spectrum data by moving the amplitude spectrum distribution represented by the amplitude spectrum data along the frequency axis in accordance with the pitch;

(d) adjust, for each said spectrum distribution region, the phase spectrum distribution represented by the phase spectrum data in accordance with the adjustment of the amplitude spectrum data; and (e) convert the adjusted amplitude spectrum data and the adjusted phase spectrum data into a synthesized voice signal of a time region.

17. A singing voice synthesizing apparatus, comprising:

a reading device that reads voice waveform data representing a waveform corresponding to a voice synthesis unit as voice synthesis unit data from a voice synthesis unit database;

a first detecting device that detects a frequency spectrum by analyzing a freguency of the voice waveform represented by the voice waveform data;

a second detecting device that detects a plurality of local peaks of a spectrum intensity on the frequency spectrum;

a first generating device that designates, for each of the plurality of the local peaks, a spectrum distribution region including the local peak and spectrums therebefore and thereafter on the frequency spectrum and generates amplitude spectrum data representing an amplitude spectrum distribution depending on a freguency axis for each spectrum distribution region;

a second generating device that generates phase spectrum data representing a phase spectrum distribution depending on the frequency axis for each said spectrum distribution region; and a database for storing the amplitude spectrum data and the phase spectrum data corresponding to the voice synthesis unit of the voice to be synthesized.

* * * * *